US008334644B2

(12) United States Patent
Ramer et al.

(10) Patent No.: US 8,334,644 B2
(45) **Date of Patent: *Dec. 18, 2012**

(54) LIGHTING USING SOLID STATE DEVICE AND PHOSPHORS TO PRODUCE LIGHT APPROXIMATING A BLACK BODY RADIATION SPECTRUM

(75) Inventors: David P. Ramer, Reston, VA (US); Jack C. Rains, Jr., Herndon, VA (US)

(73) Assignee: ABL IP Holding LLC, Conyers, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/237,636

(22) Filed: Sep. 20, 2011

(65) Prior Publication Data

US 2012/0007125 A1 Jan. 12, 2012

Related U.S. Application Data

(63) Continuation of application No. 12/776,966, filed on May 10, 2010, now Pat. No. 8,089,207.

(51) Int. Cl.
*H01J 1/62* (2006.01)

(52) U.S. Cl. ..... 313/498; 313/499; 313/501

(58) Field of Classification Search ..... 313/498, 313/499, 501

See application file for complete search history.

(56) References Cited

U.S. PATENT DOCUMENTS

| | | | |
|---|---|---|---|
| 5,608,213 | A | 3/1997 | Pinkus et al. |
| 5,803,592 | A | 9/1998 | Lawson |
| 5,877,490 | A | 3/1999 | Ramer et al. |
| 5,914,487 | A | 6/1999 | Ramer et al. |
| 6,007,225 | A | 12/1999 | Ramer et al. |
| 6,222,623 | B1 | 4/2001 | Wetherell |
| 6,234,648 | B1 | 5/2001 | Borner et al. |
| 6,286,979 | B1 | 9/2001 | Ramer et al. |
| 6,357,889 | B1 | 3/2002 | Duggal et al. |
| 6,361,192 | B1 | 3/2002 | Fussell et al. |
| 6,422,718 | B1 | 7/2002 | Anderson et al. |
| 6,437,861 | B1 | 8/2002 | Kuta |
| 6,447,698 | B1 | 9/2002 | Ihara et al. |
| 6,473,554 | B1 | 10/2002 | Pelka et al. |
| 6,536,914 | B2 | 3/2003 | Hoelen et al. |
| 6,566,824 | B2 | 5/2003 | Panagotacos et al. |
| 6,692,136 | B2 | 2/2004 | Marshall et al. |

(Continued)

FOREIGN PATENT DOCUMENTS

JP 2007-291353 11/2007

(Continued)

OTHER PUBLICATIONS

Pradhan, Narayan, et al., "An Alternative of CdSe Nanocrystal Emitters: Pure and Tunable Impurity Emissions in ZnSe Nonocrystals", Nov. 24, 2005, 127, pp. 17586-17587, J. A, Chem, Soc. Communications, web publication.

(Continued)

*Primary Examiner* — Vip Patel
(74) *Attorney, Agent, or Firm* — McDermott Will & Emery LLP

(57) ABSTRACT

Solid state light emitting devices and/or solid state lighting devices use three or more phosphors excited by energy from a solid state source. The phosphors are selected and included in proportions such that the visible light output of such a device exhibits a radiation spectrum that approximates a black body radiation spectrum for the rated color temperature for the device, over at least a predetermined portion of the visible light spectrum.

35 Claims, 15 Drawing Sheets

U.S. PATENT DOCUMENTS

| | | | |
|---|---|---|---|
| 6,700,112 | B2 | 3/2004 | Brown |
| 6,737,681 | B2 | 5/2004 | Koda |
| 6,836,083 | B2 | 12/2004 | Mukai |
| 6,869,545 | B2 | 3/2005 | Peng et al. |
| 6,872,249 | B2 | 3/2005 | Peng et al. |
| 6,960,872 | B2 | 11/2005 | Beeson et al. |
| 6,969,843 | B1 | 11/2005 | Beach et al. |
| 6,985,163 | B2 | 1/2006 | Riddle et al. |
| 6,995,355 | B2 | 2/2006 | Rains, Jr. et al. |
| 7,025,464 | B2 | 4/2006 | Beeson et al. |
| 7,040,774 | B2 | 5/2006 | Beeson et al. |
| 7,102,152 | B2 | 9/2006 | Chua et al. |
| 7,105,051 | B2 | 9/2006 | Peng et al. |
| 7,144,131 | B2 | 12/2006 | Rains |
| 7,148,632 | B2 | 12/2006 | Berman et al. |
| 7,153,703 | B2 | 12/2006 | Peng et al. |
| 7,160,525 | B1 | 1/2007 | Peng et al. |
| 7,192,850 | B2 | 3/2007 | Chen et al. |
| 7,220,039 | B2 | 5/2007 | Ahn et al. |
| 7,235,190 | B1 | 6/2007 | Wilcoxon et al. |
| 7,235,792 | B2 | 6/2007 | Elofson |
| 7,273,904 | B2 | 9/2007 | Peng et al. |
| 7,294,956 | B2 | 11/2007 | Maeda et al. |
| 7,350,933 | B2 | 4/2008 | Ng et al. |
| 7,374,807 | B2 | 5/2008 | Parce et al. |
| 7,531,149 | B2 | 5/2009 | Peng et al. |
| 7,560,677 | B2 | 7/2009 | Lyons et al. |
| 7,768,192 | B2 | 8/2010 | Van De Ven et al. |
| 2004/0151008 | A1 | 8/2004 | Artsyukhovich et al. |
| 2004/0188594 | A1 | 9/2004 | Brown et al. |
| 2006/0022582 | A1 | 2/2006 | Radkov |
| 2006/0072314 | A1 | 4/2006 | Rains |
| 2007/0045524 | A1 | 3/2007 | Rains, Jr. et al. |
| 2007/0051883 | A1 | 3/2007 | Rains, Jr. et al. |
| 2007/0138978 | A1 | 6/2007 | Rains, Jr. et al. |
| 2007/0170454 | A1 | 7/2007 | Andrews |
| 2007/0278930 | A1 | 12/2007 | Takahashi et al. |
| 2008/0030974 | A1 | 2/2008 | Abu-Ageel |
| 2008/0094835 | A1 | 4/2008 | Marra et al. |
| 2008/0106887 | A1 | 5/2008 | Salsbury et al. |
| 2008/0224025 | A1 | 9/2008 | Lyons et al. |
| 2009/0003002 | A1 | 1/2009 | Sato |
| 2009/0295266 | A1 | 12/2009 | Ramer et al. |
| 2009/0296368 | A1 | 12/2009 | Ramer |
| 2011/0095686 | A1 | 4/2011 | Falicoff et al. |

FOREIGN PATENT DOCUMENTS

| | | | |
|---|---|---|---|
| WO | WO 2005/101445 | A1 | 10/2005 |
| WO | WO 2009/063915 | A1 | 5/2009 |

OTHER PUBLICATIONS

"Energy Star Program Requirements for Solid State Lighting Luminaires Eligibility Criteria—Version 1.0", Manual, Sep. 12, 2007.

Yin, Yadong and A. Paul Alivisatos, "Colloidal nanocrystal sythesis and the organic-inorganic interface", Insight Review, Sep. 25, 2005, pp. 664-670, Nature vol. 437.

"Final Report: Highly Bright, Heavy Metal-Free, and Stable Doped Semiconductor Nanophosphors for Economical Solid State Lighting Alternatives", Report, Nov. 12, 2009, pp. 1-3, National Center for Environmental Research, web publication.

"Solid-State Lighting: Development of White LEDs Using Nanophosphor-InP Blends", Report, Oct. 26, 2009, p. 1, U.S. Department of Energy—Energy Efficiency and Renewable Energy, web publication.

"Solid-State Lighting: Improved Light Extraction Efficiencies of White pc-LEDs for SSL by Using Non-Toxic, Non-Scattering, Bright, and Stable Doped ZnSe Quantum Dot Nanophosphors (Phase I)", Report, Oct. 26, 2009, pp. 1-2, U.S. Department of Energy—Energy Efficiency and Renewable Energy, web publication.

"Chemistry—All in the Dope", Editor's Choice, Dec. 9, 2005, Science, vol. 310, p. 1, AAAS, web publication.

"D-dots: Heavy Metal Free Doped Semiconductor Nanocrystals", Technical Specifications, etc. Dec. 1, 2009, pp. 1-2, NN-LABS, LLC (Nanomaterials & Nanofabrication Laboratories), CdSe/ZnS Semiconductor Nanocrystals, web publication.

U.S. Appl. No. 12/609,523 titled "Heat Sinking and Flexible Circuit Board, for Solid State Light Fixture Utilizing an Optical Cavity".

U.S. Appl. No. 12/629,614 titled "Light Fixture Using UV Solid State Device and Report Semiconductor Nanophosphors to Produce White Light".

U.S. Appl. No. 12/697,596 titled "Lamp Using Solid State Source and Doped Nanophosphor".

U.S. Appl. No. 12/729,788 titled "Solid State Tubular Lamp Using Doped Nanophosphors for Producing High-CRI White Light for Florescence Replacement or the Like".

U.S. Appl. No. 12/629,599 titled "Solid State Light Emitter With Near-UV Pumped Nanophosphors for Producing High CRI White Light".

Transmittal of International Search Report and the Written Opinion of the International Searching Authority issued in International Application No. PCT/US2011/029212 dated Sep. 12, 2011.

Entire Prosecution of U.S. Appl. No. 12/776,966 to Ramer, et al., filed May 10, 2010, entitled "Lighting Using Solid State Device and Phosphors to Produce Light Approximating a Black Body Radiation Spectrum."

LIGHTING USING SOLID STATE DEVICE AND PHOSPHORS TO PRODUCE LIGHT APPROXIMATING A BLACK BODY RADIATION SPECTRUM

RELATED APPLICATIONS

This application is a Continuation of U.S. application Ser. No. 12/776,966, filed on May 10, 2010, now U.S. Pat. No. 8,089,207, the disclosure of which is incorporated by reference herein.

TECHNICAL FIELD

The present subject matter relates to techniques, light emitting devices, and lighting devices including light fixtures and lamps, as well as to lighting systems that use such devices, to produce perceptible white light, for example for general lighting applications, using pumped phosphors, such that light output exhibits a desired color temperature and has a spectral characteristic corresponding to a portion of the black body radiation spectrum for the desired color temperature.

BACKGROUND

As costs of energy increase along with concerns about global warming due to consumption of fossil fuels to generate energy, there is an every increasing need for more efficient lighting technologies. These demands, coupled with rapid improvements in semiconductors and related manufacturing technologies, are driving a trend in the lighting industry toward the use of light emitting diodes (LEDs) or other solid state light sources to produce light for general lighting applications, as replacements for incandescent lighting and eventually as replacements for other older less efficient light sources.

The actual solid state light sources, however, produce light of specific limited spectral characteristics. To obtain white light of a desired characteristic and/or other desirable light colors, one approach uses sources that produce light of two or more different colors or wavelengths and one or more optical processing elements to combine or mix the light of the various wavelengths to produce the desired characteristic in the output light. In recent years, techniques have also been developed to shift or enhance the characteristics of light generated by solid state sources using phosphors, including for generating white light using LEDs. Phosphor based techniques for generating white light from LEDs, currently favored by LED manufacturers, include UV or Blue LED pumped phosphors. In addition to traditional phosphors, semiconductor nanophosphors have been used more recently. The phosphor materials may be provided as part of the LED package (on or in close proximity to the actual semiconductor chip), or the phosphor materials may be provided remotely (e.g. on or in association with a macro optical processing element such as a diffuser or reflector outside the LED package). The remote phosphor based solutions have advantages, for example, in that the color characteristics of the fixture output are more repeatable, whereas solutions using sets of different color LEDs and/or lighting fixtures with the phosphors inside the LED packages tend to vary somewhat in light output color from fixture to fixture, due to differences in the light output properties of different sets of LEDs (due to lax manufacturing tolerances of the LEDs).

Although these solid state lighting technologies have advanced considerably in recent years, there is still room for further improvement. For example, even with LED pumped phosphors, the spectrum of light produced at a particular color temperature tends to be somewhat undesirable or unnatural. Due to peaks, or valleys or gaps in the output spectrum in the visible light range, objects of certain colors may not appear in a desired or natural way when illuminated by the output light. Hence, further improvement in the spectral characteristic of fixture of lamp output is possible.

SUMMARY

The teachings herein provide further improvements over the existing technologies for providing light that is at least substantially white=. Phosphors excited by energy from a solid state source produce visible light for inclusion in an output of the device, such that the light output exhibits a radiation spectrum that approximates a black body radiation spectrum for the rated color temperature for the device, over at least a predetermined portion of the visible light spectrum.

For example, a disclosed light emitting device might include a solid state source for producing electromagnetic energy of a first emission spectrum and at least three phosphors positioned to receive electromagnetic energy from the solid state source. Each of the phosphors is of a type excited in response to electromagnetic energy of the first emission spectrum from the solid state source for re-emitting visible light of a different one of a corresponding number of second emission spectra.

Although the present teachings encompass deployments in a solid state device, for example, within the device package, the examples described in detail relate to remote phosphor deployments, for example, in fixtures or lamps. In an example for a general lighting application, a lighting device includes a solid state source that contains at least one semiconductor chip within at least one package, for producing the electromagnetic energy of the first emission spectrum. This type of device also includes an optical element outside the package of the solid state source and separate from the semiconductor chip, arranged to receive electromagnetic energy of the first emission spectrum from the solid state source. In this type of lighting device, the phosphors are remotely deployed in that the phosphors are associated with the optical element and apart from the semiconductor chip.

In the examples described and shown in the drawings, a visible light output of the device contains a combination of light of all of the second emission spectra from the phosphors. When the phosphors together are excited by electromagnetic energy of the first emission spectrum from the solid state source, the visible light output of the device is at least substantially white and exhibits a color temperature corresponding to a rated color temperature for the device.

In the examples discussed in the most detail below, the visible light output of the device deviates no more than ±50% from a black body radiation spectrum for the rated color temperature for the device, over at least 210 nm of the visible light spectrum. Also, the visible light output of the device has an average absolute value of deviation of no more than 15% from the black body radiation spectrum for the rated color temperature for the device, over at least the 210 nm of the visible light spectrum.

The exemplary light emitting devices discussed in more detail below offer one or more of a variety of advantages. For example, such devices may provide a high quality of spectral content so that illumination, e.g. from a fixture or a lamp, will appear natural for most commercial lighting applications. They also can be configured to meet industry accepted performance standards, such as high CRI at one of a number particular industry accepted color temperatures.

Examples are also disclosed that offer good efficiency, to reduce energy consumption. Also, for general lighting applications, the examples may consistently provide light outputs of acceptable characteristics in a consistent repeatable manner, e.g. in lighting device examples—from one fixture or lamp to the next.

Additional advantages and novel features will be set forth in part in the description which follows, and in part will become apparent to those skilled in the art upon examination of the following and the accompanying drawings or may be learned by production or operation of the examples. The advantages of the present teachings may be realized and attained by practice or use of various aspects of the methodologies, instrumentalities and combinations set forth in the detailed examples discussed below.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

Figure 1:
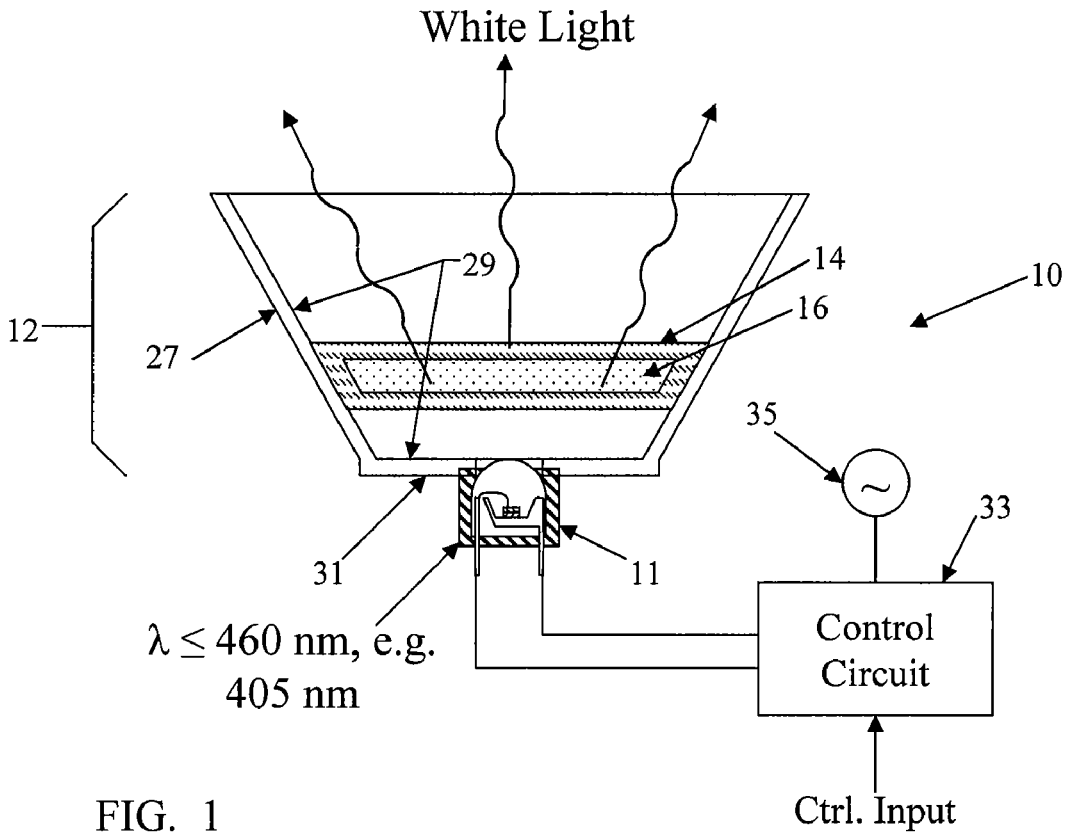
FIG. 1 illustrates an example of a light emitting system, with certain elements thereof shown in cross-section.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

It is desirable not only to meet industry accepted performance standards but while doing so to provide a high quality of spectral content so illumination from the light emitting device will appear natural for most commercial applications of a fixture type lighting device or a lamp product. For a given color temperature, a theoretical black body will emit light having a known spectral characteristic. Particularly for color temperatures corresponding to light that humans perceive as visible white light, a black body spectrum represents a natural light characteristic. Objects illuminated by such light will have expected/natural colors. Solid state light emitting devices and/or solid state lighting devices discussed below and shown in the drawings use three or more phosphors excited by energy from a solid state source. The phosphors are selected and included in proportions such that the visible light output of such a device exhibits desired spectral characteristics. In the specific examples, the visible light output of the device produced when the phosphors are excited is at least substantially white and exhibits a color temperature corresponding to (within tolerance of) a rated color temperature for the light output of the device, e.g. for a particular intended application of the light emitting device. Also, the output light exhibits a radiation spectrum that approximates a black body radiation spectrum for the rated color temperature for the device, over at least a predetermined portion of the visible light spectrum.

Reference now is made in detail to the examples illustrated in the accompanying drawings and discussed below. FIG. 1 is a simplified illustration of a lighting system 10, for emitting visible light, so as to be perceptible by a person. The system includes a solid state lighting device, which in this first example is a light fixture. A fixture portion of the system 10 is shown in cross-section (although some cross-hatching thereof has been omitted for ease of illustration). The circuit elements are shown in functional block form. The system 10 utilizes a solid state source 11, which, in this example, is rated for emitting electromagnetic energy at a wavelength in the range of 460 nm and below ($\lambda \leqq 460$ nm). Of course, there may be any number of solid state sources 11, as deemed appropriate to produce the desired level of output for the system 10 for any particular intended lighting application.

As discussed herein, applicable solid state light emitting elements or sources essentially include any of a wide range of light emitting or generating devices formed from organic or inorganic semiconductor materials. Examples of solid state light emitting elements include semiconductor laser devices and the like. Many common examples of solid state lighting elements, however, are classified as types of "light emitting diodes" or "LEDs." This exemplary class of solid state light emitting devices encompasses any and all types of semiconductor diode devices that are capable of receiving an electrical signal and producing a responsive output of electromagnetic energy. Thus, the term "LED" should be understood to include light emitting diodes of all types, light emitting polymers, organic diodes, and the like. LEDs may be individually packaged, as in the illustrated examples. Of course, LED based devices may be used that include a plurality of LEDs within one package, for example, multi-die LEDs two, three or more LEDs within one package. Those skilled in the art will recognize that "LED" terminology does not restrict the source to any particular type of package for the LED type source. Such terms encompass LED devices that may be packaged or non-packaged, chip on board LEDs, surface mount LEDs, and any other configuration of the semiconductor diode device that emits light. Solid state lighting elements may include one or more phosphors and/or quantum dots, which are integrated into elements of the package or light processing elements of the fixture to convert at least some radiant energy to a different more desirable wavelength or range of wavelengths.

The examples use one or more LEDs to supply the energy to excite the nanophosphors. The solid state source in such cases may be the collection of the LEDs. Alternatively, each LED may be considered a separate solid state source. Stated another way, a source may include one or more actual emitters.

The solid state source 11 is a semiconductor based structure for emitting electromagnetic energy. An exemplary structure includes a semiconductor chip, such as a light emitting diode (LED), a laser diode or the like, within a package or enclosure. A light transmissive portion of the package that encloses the chip, for example, an element formed of glass or plastic, allows for emission of the electromagnetic energy in the desired direction. Many such source packages include internal reflectors to direct energy in the desired direction and reduce internal losses. To provide readers a full understanding, it may help to consider a simplified example of the structure of such a solid state source 11.

Figure 2:
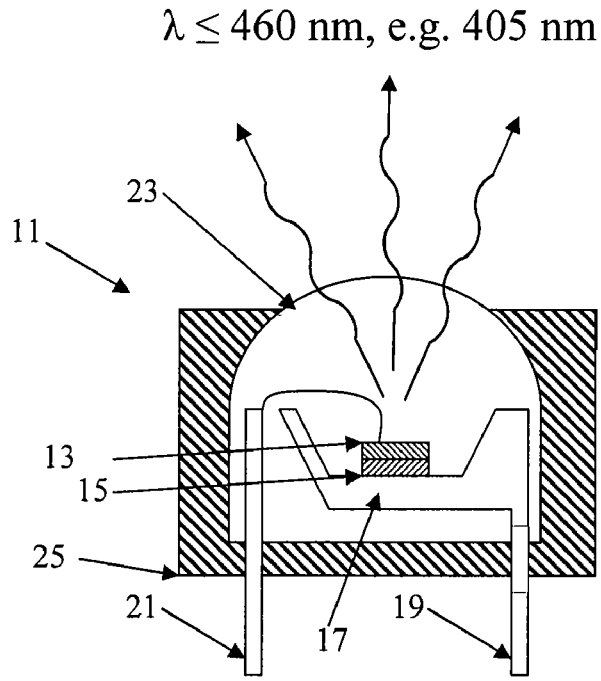
FIG. 2 is a simplified cross-sectional view of a light-emitting diode (LED) type solid state source, which may be used as the source in the system of FIG. 1.

FIG. 2 illustrates a simple example of a LED type solid state source 11, in cross section. In the example of FIG. 2, the source 11 includes at least one semiconductor chip, each comprising two or more semiconductor layers 13, 15 forming the actual LED device. The semiconductor layers 13, 15 of the chip are mounted on an internal reflective cup 17, formed as an extension of a first electrode, e.g. the cathode 19. The cathode 19 and an anode 21 provide electrical connections to layers of the semiconductor chip device within the packaging for the source 11. In the example, an epoxy dome 23 (or similar transmissive part) of the enclosure allows for emission of the electromagnetic energy from the chip in the desired direction.

In this simple example, the solid state source 11 also includes a housing 25 that completes the packaging/enclosure for the source. At least for many modern lighting applications, the housing 25 is metal, e.g. to provide good heat conductivity so as to facilitate dissipation of heat generated during operation of the LED. Internal "micro" reflectors, such as the reflective cup 17, direct energy in the desired direction and reduce internal losses. One or more elements in the package, such as the reflector 17 or dome 23 may be doped or coated with phosphor materials, to provide a semiconductor device level implementation of the phosphor centric approach to high quality spectral content white lighting. However, the examples shown and described in detail rely on remote phosphor deployment, and for such implementations, phosphor doping integrated in (on or within) the package is not required for remote semiconductor nanophosphor implementations. For the remote phosphor deployment examples, discussed in more detail here, the solid state source 11 is rated to emit electromagnetic energy of a wavelength in the range of 460 nm and below, such as 405 nm in the illustrated example; and the emission spectrum of such a device is relatively narrow.

Semiconductor devices rated for a particular wavelength, such as the solid state source 11 in the present example, exhibit emission spectra having a relatively narrow peak at a predominant wavelength, although some such devices may have a number of peaks in their emission spectra. Often, manufacturers rate such devices with respect to the intended wavelength $\lambda$ of the predominant peak, although there is some variation or tolerance around the rated value, from device to device. Solid state light source devices such as device 11 for use in the exemplary lighting system 10 will have a predominant wavelength $\lambda$ in the range at or below 460 nm ($\lambda \leqq 460$ nm), for example at 405 nm ($\lambda = 405$ nm) which is in the 380-420 nm near UV range. A LED used as solid state source 11 in the examples of FIGS. 1 and 2 that is rated for a 405 nm output, will have a predominant peak in its emission spectra at or about 405 nm (within the manufacturer's tolerance range of that rated wavelength value). The system 10, however, may use devices that have additional peaks in their emission spectra.

The structural configuration of the solid state source 11 shown in FIG. 2 is presented here by way of example only. Those skilled in the art will appreciate that the system 10 can utilize any solid state light emitting device structure, where the device is configured as a source of electromagnetic energy in the relevant wavelength range, for example, having substantial energy emissions in that range $\lambda \leqq 460$ nm, such as a predominant peak at or about 405 nm. However, as will become apparent from the discussion below, the emission spectrum of the solid state source 11 will be within the absorption spectrum of each of the one or more phosphors used in the fixture of the particular system 10.

Returning to FIG. 1, the system 10 utilizes a macro scale optic 12 together with the solid state source 11 to form a light fixture type of lighting device. The light fixture could be configured for a general lighting application. Examples of general lighting applications include downlighting, task lighting, "wall wash" lighting, emergency egress lighting, as well as illumination of an object or person in a region or area intended to be occupied by one or more people. A task lighting application, for example, typically requires a minimum of approximately 20 foot-candles (fcd) on the surface or level at which the task is to be performed, e.g. on a desktop or countertop. In a room, where the light fixture is mounted in or hung from the ceiling or wall and oriented as a downlight, for example, the distance to the task surface or level can be 35 inches or more below the output of the light fixture. At that level, the light intensity will still be 20 fcd or higher for task lighting to be effective. Of course, the fixture (11, 12) of FIG. 1 may be used in other applications, such as vehicle headlamps, flashlights, etc.

The macro scale optical processing element or 'optic' 12 in this first example includes a macro (outside the packaging of source 11) scale reflector 27. The reflector 27 has a reflective surface 29 arranged to receive at least some electromagnetic energy from the solid state source 11 and/or a remote semiconductor nanophosphor material 16. The disclosed system 10 may use a variety of different structures or arrangements for the reflector 27. For efficiency, the reflective surface 29 of the reflector 27 should be highly reflective. The reflective surface 29 may be specular, semi or quasi specular, or diffusely reflective.

In the example, the emitting region of the solid state source 11 fits into or extends through an aperture in a proximal section 31 of the reflector 27. The solid state source 11 may be coupled to the reflector 27 in any manner that is convenient and/or facilitates a particular lighting application of the system 10. For example, the source 11 may be within the volume of the reflector 27, the source may be outside of the reflector (e.g. above the reflector in the illustrated orientation) and facing to emit electromagnetic energy into the interior of the reflector, or the electromagnetic energy may be coupled from the solid source 11 to the reflector 27 via a light guide or pipe or by an optical fiber. However, close efficient coupling is preferable.

The macro optic 12 will include or have associated therewith an apparatus for producing visible light in response to electromagnetic energy from the solid state source 11. The apparatus includes a transparent or translucent material 16 and one or more phosphors dispersed in the transparent material, where the phosphors are selected and mixed in proportions to produce output light from the device 11-16 and system 10 of a desired color temperature and having a radiation spectrum approaching or approximating a portion of the black body spectrum for the rated color temperature for the lighting device or system. The apparatus could take the form of a coating on a surface within the optic 12, for example on some or all of the surface(s) 29 of the reflector 27, if the material 16 provided sufficient rigidity (e.g. took the form of a relatively solid material). In the example of FIG. 1, the apparatus is in the form of an optical processing element comprising a container 14 for the phosphor bearing material 16.

Hence, the exemplary macro optic 12 includes a container 14 formed of an optically transmissive material, at least in a portion thereof where pumping energy will enter the container and a portion thereof where light will emerge from the container as light output for the system fixture. In the example, a transparent input portion of the container receives electromagnetic energy from the solid state source 11 for excitation of the phosphors dispersed in the transparent material 16 in the container 14. In the arrangement of FIG. 1, the input portion would be the lower surface of the container 14. The output portion is transmissive at least with respect to visible light, for emission of the visible light produced by the excitation of the one or more phosphors dispersed in the transparent material in the container. The entire outer portion of the container 14 (including the input portion) may also serve as the output portion. In the example, the main output portion would be the upper surface of the container 14. However, outputs through other regions of the apparatus 14 reflect off of surface(s) 29 of reflector 27 for inclusion in the output of the lighting device 12, although such reflected light may pass back through the optical element. The output portion may be transparent or translucent, e.g. transmissive white. Hence, in the example of FIG. 1, the upper surface of the container 14 could be clear or transparent, or that portion of the container could be white.

The container 14 contains or encapsulates a transmissive material bearing the phosphors, as shown in the drawing at 16, which at least substantially fills the interior volume of the container. For example, if a liquid is used, there may be some gas in the container as well, although the gas should not include oxygen as oxygen tends to degrade the phosphors. In this example, the optical processing element formed by container 14 includes two, three or more phosphors dispersed in the material 16 in the container.

The transmissive material preferably exhibits high transmissivity and/or low absorption to light of the relevant wavelengths. The material may be a solid, although liquid or gaseous materials may help to improve the florescent emissions by the phosphors in the material. For example, alcohol, oils (synthetic, vegetable, silicon or other oils) or other liquid media may be used. An epoxy may be used, and once hardened, the epoxy material would serve as an integral container as well as the phosphor-bearing material. Such an arrangement would not require a separate physical container. Similarly, a silicone material may be cured to form a hardened material, at least along the exterior or to form a solid throughout the internal volume of the container 14 (to possibly serve as an integral container). If hardened silicon is used, however, a glass, epoxy or other oxygen impervious container still may be used to provide an oxygen barrier to reduce phosphor degradation due to exposure to oxygen.

In an example where the bearer material for the phosphors is liquid, a bubble may be created when the container is filled. If present, the bubble may be either a gas-filled bubble or a vacuum-vapor bubble.

If the bubble contains a deliberately provided gas, that gas should not contain oxygen or any other element that might interact with the phosphors. Nitrogen would be one appropriate example of a gas that may be used.

If the bubble is a vacuum-vapor bubble, the bubble is formed by drawing a vacuum, for example, due to the properties of the suspension or environmental reasons. If a gas is not deliberately provided, vapors from the liquid will almost certainly be present within the vacuum, whenever conditions would create some vacuum pressure within the container. For example, the vacuum-vapor bubble might form due to a vacuum caused by a differential between a volume of the liquid that is less than the volume of the interior of the container. This might occur for example due to a low temperature of the liquid, for example, if the liquid is placed in the container while hot and allowed to cool or if the liquid is of such an amount as to precisely fill the container at a designated operating temperature but the actual temperature is below the operating temperature. Any vapor present would be caused by conversion of the liquid to a gas under the reduced pressure.

In either case, the gas bubble or the vacuum-vapor bubble can be sized to essentially disappear when the suspension material reaches its nominal operating temperature, with sizing such that the maximum operating pressure is not exceeded at maximum operating temperature. If it is a gas-filled bubble, it will get smaller, but will probably not completely disappear with increased temperature. The preferred embodiment is a vacuum-vapor bubble, which may disappear completely at appropriate temperatures.

If a gas is used, the gaseous material, for example, may be hydrogen gas, any of the inert gases, and possibly some hydrocarbon based gases. Combinations of one or more such types of gases might be used.

Hence, although the material in the container may be a solid, further discussion of the examples will assume use of a liquid or gaseous material.

The material is transmissive and has one or more properties that are wavelength independent. A clear material used to bear the phosphors would have a low absorptivity with little or no variation relative to wavelengths, at least over most if not all of the visible portion of the spectrum. If the material is translucent, its scattering effect due to refraction and/or reflection will have little or no variation as a function of wavelength over at least a substantial portion of the visible light spectrum.

For further discussion of this first fixture example, we will assume that the entire container is optically transmissive. The material forming the walls of the container 14 also may exhibit high transmissivity and/or low absorption to light of the relevant wavelengths. The walls of the container 14 may be smooth and highly transparent or translucent, and/or one or more surfaces may have an etched or roughened texture. Of course, some portions may be reflective, e.g. along the sidewalls in the illustrated example.

As outlined above, the phosphors dispersed in the material shown at 16 are of types or configurations (e.g. selected types of semiconductor nanophosphors and/or doped semiconductor nanophosphors) excitable by the relevant emission spectrum of energy from the solid state source 11. In the illustrated example, the phosphors may have absorption spectra that include some or all of the near UV range, in particular the 405 nm emission spectrum of the exemplary LED source 11. Stated another way, the absorption spectrum of each phosphor encompasses at least a substantial portion and sometimes all of the emission spectrum of the LED type solid state source. When excited by electromagnetic energy in its absorption spectrum from the solid state source, each phosphor emits visible light in a characteristic emission spectrum. Where the phosphor is a semiconductor nanophosphor, particularly a doped semiconductor nanophosphor, the phosphor emission spectrum may be separated from the absorption spectrum of the phosphor. The lighting device is configured so that a visible light output of the lighting device for the intended lighting application contains a combination of light of all of the emission spectra from the phosphors, when the remote phosphors together are excited by electromagnetic energy of the emission spectrum from the solid state source. Stated another way, excited phosphor emissions from each phosphor in the material 16 will be included in a light output for the fixture.

The lighting fixtures, lamps or other light emitting devices utilize two, three or more phosphors excited so that the light output exhibits desired characteristics, particularly a color temperature within a tolerance or range for the rated temperature of the device and approaching or approximating a section of the black body radiation spectrum for the rated color temperature. We will discuss aspects of the phosphor light generation and attendant device output characteristics before discussing specific examples of appropriate phosphors.

For purposes of discussion of light emission or generation and associated color or spectral characteristics of the light, a "black body" is a theoretically ideal body that emits or radiates a continuous spectrum of light, where the radiation spectrum varies as a function of the temperature of the black body. When cold, the body does not reflect or transmit light and therefore would appear "black." However, at a particular temperature, it emits a characteristic broad continuous spectrum. There is a range of temperatures for the black body where the body would produce visible light exhibiting spectral characteristics humans consider to be visible white light. These points correspond to a range along the "black body" curve (termed the Planckian locus) on the CIE color chart. Because of the broad continuous spectral output of the black body, white light corresponding to such points on the on the black body curve provides high quality spectral content, which humans tend to perceive as "natural light." Hence, a lighting device outputting white light of a spectrum the same as or similar to a black body radiation spectrum would provide a high quality spectral content desirable for many lighting applications.

A number of color temperatures are particularly useful in common general lighting applications. For a perfect black body source, the color of the light output would fall on the black body curve (Planckian locus) on the CIE color chart. However, practical lighting devices may not be ideal, and ranges around points on the black body curve (Planckian locus) on the CIE color chart produce commercially acceptable results, e.g. for many general lighting applications.

In a white light type example of the system 10, the excited phosphors together enable the light emitting device to produce output light that is at least substantially white and has a high quality spectral content, e.g. corresponding to a high color rendering index (CRI) (e.g. of 85 or higher). The output light produced during this excitation of the semiconductor nanophosphors exhibits color temperature in one of several desired ranges along the black body curve in the visible color space, for example, on the CIE color chart. Examples discussed below use mixtures containing four different phosphors. Different light fixtures, lamps or other light emitting devices designed for different color temperatures of white output light would use different formulations or mixtures of the phosphors. Alternatively, different light fixtures, lamps or other light emitting devices designed for different color temperatures of white output light may use one or more different or additional phosphors in the mix.

Examples of the white output light of the system 10 may exhibit color temperature in one of the specific ranges along the black body curve listed in Table 1 below.

TABLE 1

Nominal Color Temperatures and Corresponding Color Temperature Ranges

| Nominal Color Temp. (° Kelvin) | Color Temp. Range (° Kelvin) |
|---|---|
| 2700 | 2725 ± 145 |
| 3000 | 3045 ± 175 |
| 3500 | 3465 ± 245 |
| 4000 | 3985 ± 275 |
| 4500 | 4503 ± 243 |
| 5000 | 5028 ± 283 |
| 5700 | 5665 ± 355 |
| 6500 | 6530 ± 510 |

Figure 3:
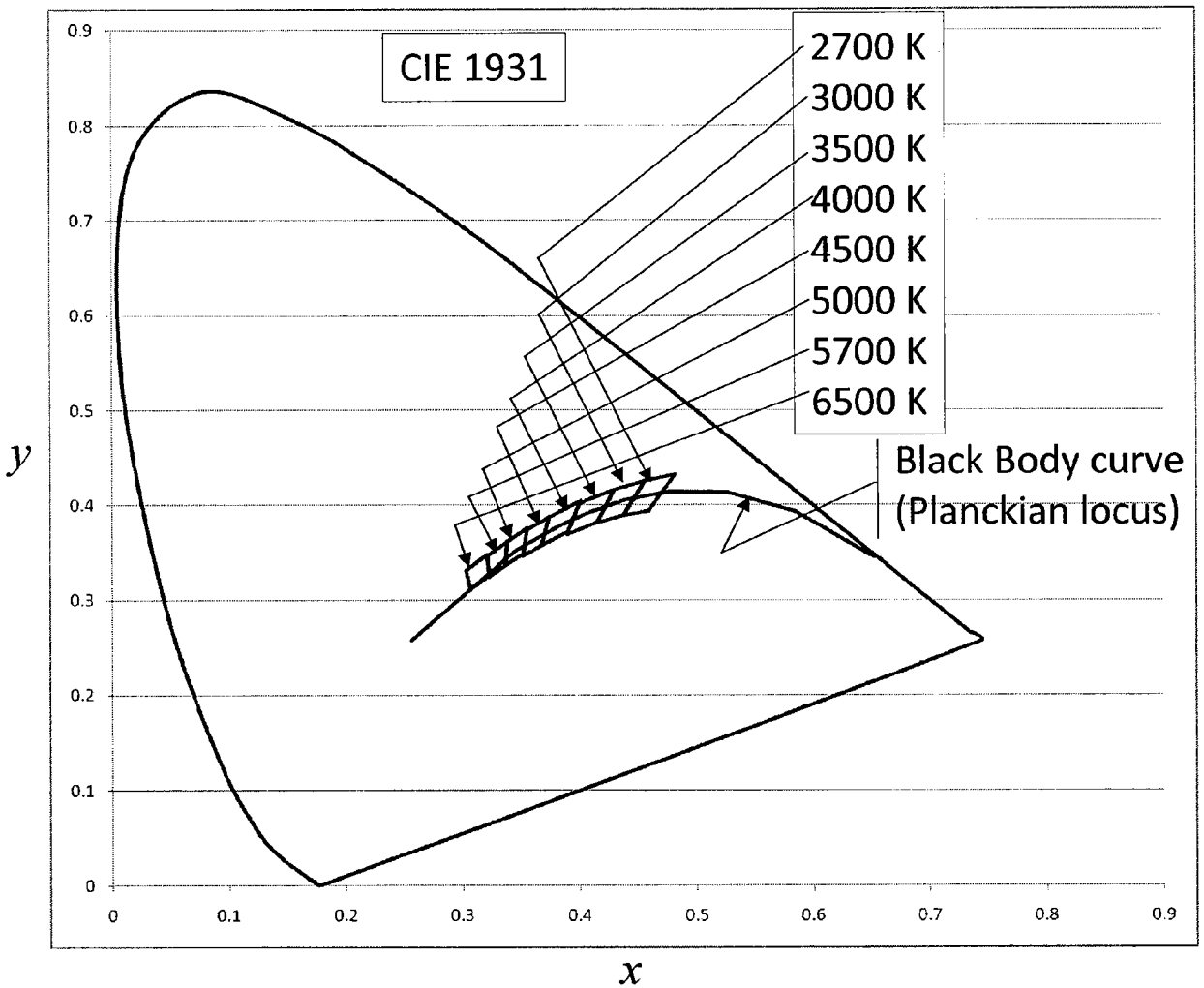
FIG. 3 is a color chart showing the black body curve and tolerance quadrangles along that curve for chromaticities corresponding to a number of color temperature ranges that are desirable in many general lighting applications.

In Table 1, each nominal color temperature value represents the rated or advertised temperature as would apply to particular fixture or lamp products having an output color temperature within the corresponding range. The color temperature ranges fall along the black body curve (Planckian locus). FIG. 3 shows the outline of the CIE 1931 color chart, and the curve across a portion of the chart represents a section of the black body curve that includes the desired CIE color temperature (CCT) ranges. The light may also vary somewhat in terms of chromaticity from the color coordinates of points on the black body curve. The quadrangles shown in the drawing represent the respective ranges of chromaticity for the nominal CCT values. Each quadrangle is defined by the range of CCT and the distance from the black body curve. Table 2 (in parts 2A and 2B) below provides chromaticity specifications for the eight exemplary color temperature ranges. The x, y coordinates define the center points on the black body curve and the vertices of the tolerance quadrangles diagrammatically illustrated in the color chart of FIG. 3.

Of note, 5400° Kelvin corresponds to an accepted color temperature range for sunlight in the daytime, and that color temperature is within the 5700 range. For example, a light emitting device (e.g. light fixture, lamp, LED or the like) rated advertised at 5400° Kelvin may be of some commercial interest as it corresponds to the solar daylight spectrum, e.g. as might be desirable for a 'day light' product.

TABLE 2A

Chromaticity Specification for Nominal Values/CCT Ranges (for rated/nominal CCTs of 2700° K to 4000° K)

| | CCT Range | | | | | | | |
|---|---|---|---|---|---|---|---|---|
| | 2725 ± 145 | | 3045 ± 175 | | 3465 ± 245 | | 3985 ± 275 | |
| | Nominal CCT | | | | | | | |
| | 2700° K | | 3000° K | | 3500° K | | 4000° K | |
| | x | y | x | y | x | y | x | y |
| Center point | 0.4578 | 0.4101 | 0.4338 | 0.4030 | 0.4073 | 0.3917 | 0.3818 | 0.3797 |
| | 0.4813 | 0.4319 | 0.4562 | 0.4260 | 0.4299 | 0.4165 | 0.4006 | 0.4044 |
| Tolerance | 0.4562 | 0.4260 | 0.4299 | 0.4165 | 0.3996 | 0.4015 | 0.3736 | 0.3874 |
| Quadrangle | 0.4373 | 0.3893 | 0.4147 | 0.3814 | 0.3889 | 0.3690 | 0.3670 | 0.3578 |
| | 0.4593 | 0.3944 | 0.4373 | 0.3893 | 0.4147 | 0.3814 | 0.3898 | 0.3716 |

TABLE 2B

Chromaticity Specification for Nominal Values/CCT Ranges (for rated/nominal CCTs of 4500° K to 6500° K)

| | CCT Range | | | | | | | |
|---|---|---|---|---|---|---|---|---|
| | 4503 ± 243 | | 5028 ± 283 | | 5665 ± 355 | | 6530 ± 510 | |
| | Nominal CCT | | | | | | | |
| | 4500° K | | 5000° K | | 5700° K | | 6500° K | |
| | x | y | x | y | x | y | x | y |
| Center point | 0.3611 | 0.3658 | 0.3447 | 0.3553 | 0.3287 | 0.3417 | 0.3123 | 0.3282 |
| | 0.3736 | 0.3874 | 0.3551 | 0.3760 | 0.3376 | 0.3616 | 0.3205 | 0.3481 |
| Tolerance | 0.3548 | 0.3736 | 0.3376 | 0.3616 | 0.3207 | 0.3462 | 0.3028 | 0.3304 |
| Quadrangle | 0.3512 | 0.3465 | 0.3366 | 0.3369 | 0.3222 | 0.3243 | 0.3068 | 0.3113 |
| | 0.3670 | 0.3578 | 0.3515 | 0.3487 | 0.3366 | 0.3369 | 0.3221 | 0.3261 |

The solid state lighting system 10 could use a variety of different combinations of phosphors to produce any output within a selected one of the CCT and chromaticity ranges of Tables 1 and 2. Mixtures of types of semiconductor nanophosphors to produce such outputs are discussed more, by way of examples, later. The phosphors are selected and combined in amounts that cause the output of the lighting device to exhibit the desired characteristics, in this case, including close correspondence to or approximation of a section of the black body radiation spectrum for the rated color temperature.

As outlined earlier, the radiation spectrum of a black body at a particular white light color temperature may be considered a theoretical ideal for natural lighting, at least for many white lighting applications. For example, a black body radiation spectrum produces a perfect 100 CRI value, for a given color temperature. An ideal light source for an application requiring a particular color temperature of white light therefore might provide a radiation spectrum conforming to the black body radiation spectrum for that color temperature and therefore would exhibit a perfect CRI score. Hence, it would be desirable for a solid state light emitting device to provide a color temperature output in a selected one of the ranges and chomraticity quadrangles listed in the tables above, and for the selected temperature range, to provide a radiation spectrum in the output that approaches or approximates the black body radiation spectrum for the nominal or rated color temperature over at least a substantial section of the humanly visible portion of the electromagnetic spectrum.

The CIE color rendering index or "CRI" is a standardized measure of the ability of a light source to reproduce the colors of various objects, based on illumination of standard color targets by a source under test for comparison to illumination of such targets by a reference source. CRI, for example, is currently used as a metric to measure the color quality of white light sources for general lighting applications. Presently, CRI is the only accepted metric for assessing the color rendering performance of light sources. However, it has been recognized that the CRI has drawbacks that limit usefulness in assessing the color quality of light sources, particularly for LED based lighting products. NIST has recently been working on a Color Quality Scale (CQS) as an improved standardized metric for rating the ability of a light source to reproduce the colors of various objects. The spectral quality of the white light produced by black bodies and by the systems discussed herein is discussed in terms of CRI, as that is the currently available/accepted metric. Those skilled in the art will recognize, however, that the systems may be rated in future by corresponding high measures of the quality of the white light outputs using appropriate values on the CQS once that scale is accepted as an appropriate industry standard. Of course, other even more accurate metrics for white light quality measurement may be developed in future.

At least for the relevant color temperatures, the radiation spectrum of a black body encompasses the humanly visible portion of the electromagnetic spectrum, but it also encompasses more of the electromagnetic spectrum. Even within the humanly visible portion of the electromagnetic spectrum, regions in the middle of the spectrum are more important for commercial lighting applications than portions approaching the extremes of the humanly visible portion of the electromagnetic spectrum.

An ideal such as a black body radiation spectrum is likely difficult and/or expensive to achieve in a commercial solid state lighting product. LED manufacturers today offer LEDs rated to provide a CRI of 85. The intent here is to provide high spectral light approaching a black body radiation spectrum over at least a particular range of the visible spectrum. Hence, an analysis was performed on data for black body radiation spectra for the various color temperatures of interest to identify the portion of each black body radiation spectrum that produced a CRI at or above 85.

An output spectrum of an actual lighting device will not and typically need not extend as far toward or beyond the edges of the humanly visible portion of the electromagnetic spectrum. The humanly visible portion of the electromagnetic spectrum is centered around 555 nm. It is possible to consider spectral quality, such as CRI, over a portion of the visible spectrum including a portion centered around 555 nm, to determine the wavelength range in which a truncated black body radiation spectrum would still provide the desired spectral performance, that is to say a CRI at or above 85 in our example.

Hence, as a metric of performance, it would be useful for a light emitting device to produce an output spectrum that approaches or approximates the black body radiation spectrum for the rated color temperature of the device, over that portion of the visible spectrum in which the black body radiation spectrum exhibits CRI of 85 or higher. CRI analysis was performed on data regarding black body radiation spectra for the exemplary nominal or rated color temperatures discussed above, over a number of wavelength ranges centered around 555 nm. From this analysis, it was found that a range of 210 nm of the visible light portion of the black body spectrum for each rated color temperature, such as the 450-660 nm (centered around 555 nm), resulted in CRI of a CRI at or above 85, for the color nominal or rated temperatures under consideration herein. Specific CRI results, for the 210 nm section of the black body radiation spectrum from 450 to 660 nm (truncated), are shown in Table 3 below.

TABLE 3

CRI Results, for a 450-660 nm Portion of the Respective Black Radiation Spectrum at Nominal Color Temperatures

| Nominal Color Temp. (° Kelvin) | CRI for BB Spectrum 450-660 nm |
|---|---|
| 2700 | 92 |
| 3000 | 92 |
| 3500 | 90 |
| 4000 | 89 |
| 4500 | 87 |
| 5000 | 86 |
| 5700 | 85 |
| 6500 | 85 |

As shown in the table, for the selected color temperatures in the range of 2700 to 6500° Kelvin, the 450-660 nm portion of the respective black body radiation spectrum produces a CRI of 85 or higher. Based on this analysis of black body radiation spectra and associated CRI, it was determined that a desirable performance target for a high spectral quality solid state light emitting device output would be to approach or approximate a black body radiation spectrum for the rated color temperature for the device, over at least 210 nm of the visible light portion of the black body radiation spectrum for the rated color temperature, e.g. over the 450-660 nm range (centered around 555 nm).

The light emitting devices under consideration here may use a variety of different types of phosphors. However, it may be helpful to consider specific examples of phosphors that are believed to be suitable for producing a high spectral quality solid state light output that approaches or approximates a black body radiation spectrum for the rated color temperature for the device over the 210 nm bandwidth of the visible light spectrum.

Semiconductor nanophosphors are nanoscale crystals or "nanocrystals" formed of semiconductor materials, which exhibit phosphorescent light emission in response to excitation by electromagnetic energy of an appropriate input spectrum (excitation or absorption spectrum). Examples of such nanophosphors include quantum dots (q-dots) formed of semiconductor materials. Like other phosphors, quantum dots and other semiconductor nanophosphors absorb light of one wavelength band or spectrum and re-emit light at a different band of wavelengths or different spectrum. However, unlike conventional phosphors, optical properties of the semiconductor nanophosphors can be more easily tailored, for example, as a function of the size of the nanocrystals. In this way, for example, it is possible to adjust the absorption spectrum and/or the emission spectrum of a semiconductor nanophosphor by controlling crystal formation during the manufacturing process so as to change the size of the nanocrystals. For example, nanocrystals of the same material, but with different sizes, can absorb and/or emit light of different colors. For at least some semiconductor nanophosphor materials, the larger the nanocrystals, the redder the spectrum of re-emitted light; whereas smaller nanocrystals produce a bluer spectrum of re-emitted light. Doped semiconductor nanophosphors are somewhat similar in that they are nanocrystals formed of semiconductor materials. However, this later type of semiconductor nanophosphors is doped, for example, with a transition metal or a rare earth metal. The examples discussed more specifically below utilize mixtures of semiconductor nanophosphors. The mixtures may use only three or more doped semiconductor nanophosphors, or three or more non-doped semiconductor nanophosphors. In several specific examples, the mixtures use four semiconductor nanophosphors, in which three of the phosphors are doped semiconductor nanophosphors and one is a non-doped semiconductor nanophosphor.

Semiconductor nanophosphors, including doped semiconductor nanophosphors, may be grown by a number of techniques. For example, colloidal nanocrystals are solution-grown, although non-colloidal techniques are possible.

For a high spectral content quality type of white light application, a material containing or otherwise including a dispersion of semiconductor nanophosphors, of the type discussed in the examples herein, would contain two, three or more different types of semiconductor nanocrystals sized and/or doped so as to be excited by the light energy in the relevant part of the spectrum. In several examples, absorption spectra have upper limits somewhere between 430 and 460 nm (nanometers), and the light emitting devices use one or more LEDs rated to emit light in a comparable portion of the spectrum. The different types of nanocrystals (e.g. semiconductor material, crystal size and/or doping properties) in the mixture are selected by their emission spectra, so that together the excited nanophosphors provide light output for the device that has the spectral quality of white light for a rated color temperature, meeting the spectral quality parameters discussed herein, when all are excited by the energy from the relevant type of solid state source.

Doped semiconductor nanophosphors exhibit a relatively large Stokes shift, from lower wavelength of absorption spectra to higher wavelength emissions spectra. In several specific examples, each of the doped semiconductor nanophosphors is of a type excited in response to near UV electromagnetic energy in the range of 380-420 nm and/or UV energy in a range of 380 nm and below. Each type of nanophosphor re-emits visible light of a different spectral characteristic. At least for the doped semiconductor nanophosphors, each phosphor emission spectra has little or no overlap with excitation or absorption ranges of the doped semiconductor nanophosphors dispersed in the material. Because of the magnitudes of the shifts, these emissions are substantially free of any overlap with the absorption spectra of the phosphors, and re-absorption of light emitted by the doped semiconductor nanophosphors can be reduced or eliminated, even in applications that use a mixture of a number of such phosphors to stack the emission spectra thereof so as to provide a desired spectral characteristic in the combined light output.

The nanophosphors used in the devices discussed herein are excited by light in the near UV to blue end of the visible spectrum and/or by UV light energy. However, nanophosphors can be used that are relatively insensitive to other ranges of visible light often found in natural or other ambient white visible light. Hence, when the lighting device is off, the semiconductor nanophosphors will exhibit little or not light emissions that might otherwise be perceived as color by a human observer. The medium or material chosen to bear the nanophosphors is itself at least substantially color-neutral (e.g. transparent or translucent). Although not emitting, the particles of the semiconductor nanophosphors may have some color, but due to their small size and dispersion in the material, the overall effect is that the material with the nanophosphors dispersed therein appears at least substantially color-neutral to the human observer, that is to say it has little or no perceptible tint, when there is no excitation energy from the appropriate solid state source.

For purposes of further discussion, we will assume that the phosphors in the light emitting device include three doped semiconductor nanophosphors, for emitting blue, green and orange light. Examples of suitable doped semiconductor nanophosphor materials for the blue, green and orange phosphors are available from NN Labs of Fayetteville, Ark. In a specific example, one or more of these doped semiconductor nanophosphors comprise zinc selenide quantum dots doped with manganese or copper. A fourth phosphor is a red emitting phosphor. The fourth phosphor could be a conventional phosphor or another doped semiconductor nanophosphor, but in the examples, the fourth phosphor is a non-doped semiconductor nanophosphor.

Figure 4:
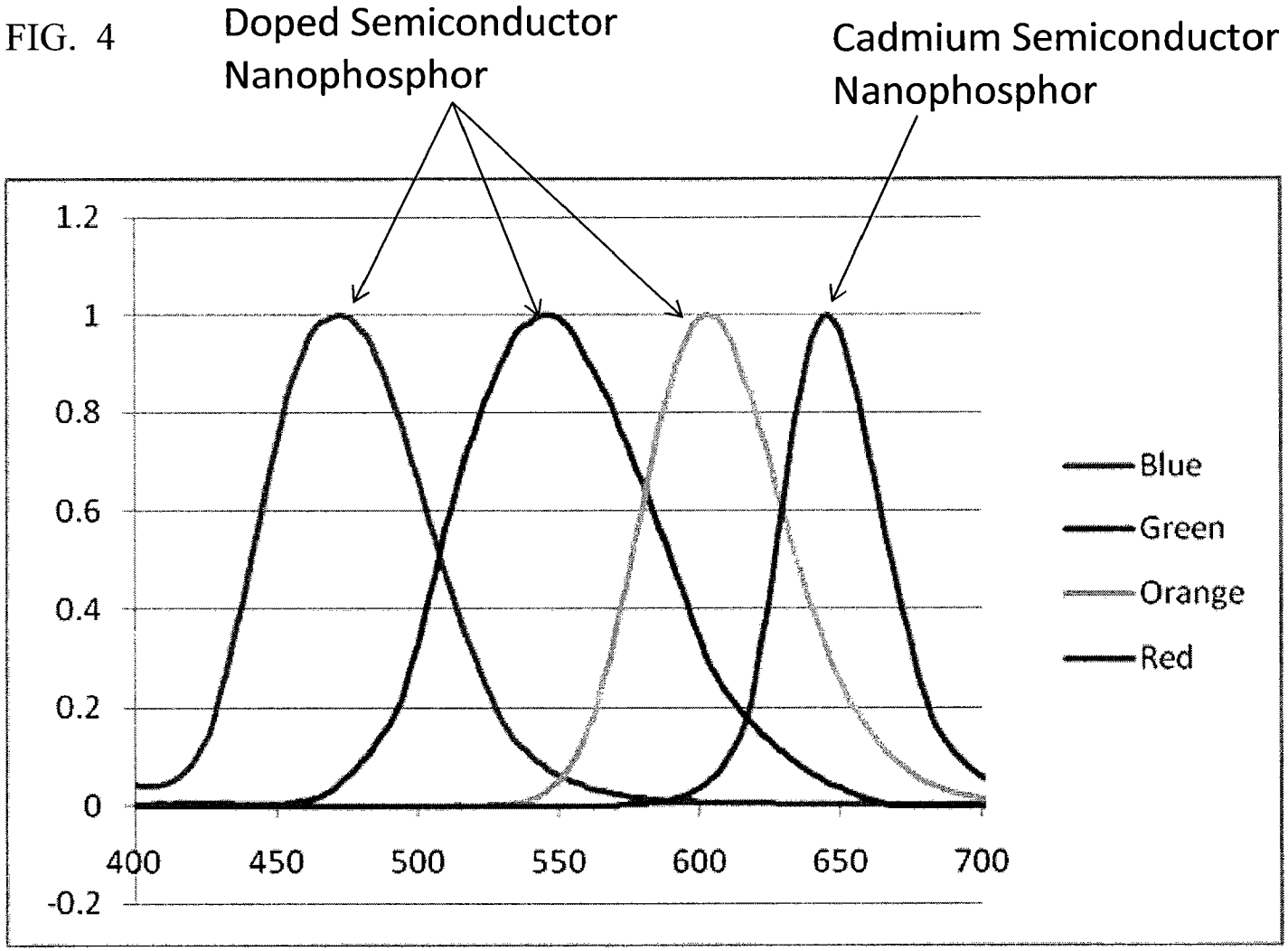
FIG. 4 is a radiation spectral graph, showing the different emission of four phosphors used in several of the examples.

FIG. 4 is a radiation spectrum graph showing a wavelength range in the visible spectrum from 400 nm to 700 nm. The four curves shown on that graph represent the four different emission spectra of the exemplary blue, green, orange and red semiconductor nanophosphors used in the specific examples. The graph of FIG. 4 shows the phosphor emissions as having the same output intensity level, e.g. in a fashion normalized with respect to intensity.

In FIG. 4, the leftmost curve represents the blue phosphor emissions. The blue phosphor is a doped semiconductor type nanophosphor. Although not shown, the absorption spectrum for this phosphor will include the 380-420 nm near UV range and extend into the UV range, but that absorption spectrum drops substantially to 0 (has an upper limit) about 450 or 460 nm. This phosphor exhibits a large Stokes shift from the short wavelength(s) of absorbed light to the longer wavelengths of re-emitted light. The emission spectrum of this blue phosphor has a broad peak in the wavelength region humans perceive as blue, e.g. centered around a wavelength approximately in the range of 470 to 475 nm in the illustrated example. The main peak of the emission spectrum of the phosphor is well above the absorption spectra of the various other semiconductor nanophosphors and well above its own absorption spectrum, although in the case of the blue example, there may be just a small amount of emissions in the region of the phosphor absorption spectra. As a result, blue emissions from this doped semiconductor nanophosphor would re-excite that phosphor at most a minimal amount. The absorption spectrum at or below 460 nm would be below the emission spectrum of the other three phosphors. Hence, the blue phosphor emissions would be subject to relatively little phosphor re-absorption, even in mixtures containing the other semiconductor nanophosphors. As shown, however, the blue phosphor provides a relatively broad radiation spectrum, as might appear as a pastel blue to a human observer.

In FIG. 4, the next curve represents the orange phosphor emissions. The orange phosphor is another doped semiconductor nanophosphor. The absorption spectrum for this phosphor includes the 380-420 nm near UV range and extends down into the UV range, but that absorption spectrum drops substantially to 0 (has an upper limit) somewhere around or a bit below 450 nm. As noted, the phosphor exhibits a large Stokes shift from the short wavelength(s) of absorbed light to the longer wavelengths of re-emitted light. The emission spectrum of this orange phosphor has a fairly broad peak in the wavelength region humans perceive as orange, e.g. centered around approximately 550 nm in the illustrated example. Again, the emission spectrum of this phosphor is well above the absorption spectra of the other doped semiconductor nanophosphors and well above its own absorption spectrum. The absorption spectrum at or below 460 nm would be below the emission spectrum of the other three phosphors, except possibly for some small overlap with the blue emission spectrum. As a result, orange emissions from the second doped semiconductor nanophosphor would not re-excite that phosphor and would not substantially excite the other semiconductor nanophosphors if mixed together. Stated another way, the orange phosphor emissions would be subject to little or no phosphor re-absorption, even in mixtures containing the other doped semiconductor nanophosphors. As shown, however, the orange phosphor provides a relatively broad radiation spectrum, as might appear as a pastel orange to a human observer.

The third line of the graph shows the emission spectrum for a green emitting doped semiconductor nanophosphor. Although not shown, the absorption spectrum for this third phosphor also includes the 380-420 nm near UV range and extends down into the UV range, but that absorption spectrum drops substantially to 0 (has an upper limit) about 450 or 460 nm. This phosphor also exhibits a large Stokes shift from the short wavelength(s) of absorbed light to the longer wavelengths of re-emitted light. The emission spectrum of this phosphor has a broad peak in the wavelength region humans perceive as green, e.g. centered around a wavelength in a range of say 600-610 nm in the illustrated example. Again, the emission spectrum of the phosphor is well above the illustrated absorption spectra of the other doped semiconductor nanophosphors and well above its own absorption spectrum. The absorption spectrum at or below 460 nm would be below the emission spectrum of the other three phosphors, except possibly for some small overlap with the blue emission spectrum. As a result, green emissions from the third doped semiconductor nanophosphor would not substantially re-excite that phosphor and would not substantially excite the other semiconductor nanophosphors if mixed together. Stated another way, the green phosphor emissions also should be subject to little or no phosphor re-absorption, even in mixtures containing the other semiconductor nanophosphors. As shown, however, the green phosphor provides a relatively broad radiation spectrum, as might appear as a pastel green to a human observer.

To increase the emissions of the device at the higher wavelength range of the 210 nm wide portion of the visible spectrum, the mixture used further includes a red emitting phosphor. Although doped semiconductor nanophosphors could be used, this example, assumes that the red phosphor is a cadmium based semiconductor nanophosphor (non-doped). Although not shown, the absorption spectrum for this fourth phosphor also includes the 380-420 nm near UV range. Depending on the phosphor used, the absorption spectrum may extend down into the UV range or may extend somewhat up into the blue range. In the later case, the red phosphor may be somewhat subject to more re-absorption of and excitation in response to emissions from the other phosphors, than was the case for the doped semiconductor nanophosphors. The emission spectrum of this fourth phosphor has a broad peak in the wavelength region humans perceive as red, e.g. centered approximately around 650 nm in the illustrated example.

Hence, in a light emitting device of the type under consideration here, each phosphor will have a characteristic emission spectra, such as the four different spectra shown in FIG. 4. Light is additive, and a light emitting device of the type discussed here will combine light from multiple phosphors to produce its light output. Hence, the light output contains a combination of light of all of the emission spectra from the phosphors, when the remote phosphors together are excited by electromagnetic energy of the emission spectrum of the solid state source. The contribution of each individual phosphor emission spectrum to the combined spectrum in the device output depends on the amount of emissions by the particular type of phosphor. Assuming that sensitivity and amount of pumping is sufficient to fully excite all of the different phosphors in the mixture, the contribution of a particular phosphor will depend on the proportional amount of that phosphor in the mixture. The combined spectrum of the device output therefore is dependent on the relative amounts of the various phosphors used in the mixture.

The light emitting device may be configured to allow some emission from the solid state source in the device output. In such a case, the phosphors do not absorb all of the emissions in the source emission range. In the specific examples, however, we will assume that the total concentration of phosphors in the mixture are sufficient to fully absorb all of the emission of electromagnetic energy from the solid state source.

As noted, variation in the proportions or percentages of different phosphors with respect to the total amount of phosphors in the mix adapts a particular light emitting device design to output different color temperatures of white light. As discussed later, an appropriate mixture of the phosphors for a selected one of the color temperatures will also result in device outputs within certain tolerance metrics with respect to the 210 nm wide section of the black body radiation spectrum for the particular nominal color temperature. Using spectral data for the relevant phosphor materials, corresponding to the respective spectra shown in FIG. 4, approximate percentage mixtures were developed as would be expected to produce outputs of the color characteristics at the specified nominal color temperatures. Table 4 below shows relative percentages of the four phosphors (blue, green and orange doped semiconductor nanophosphors; and a red semiconductor nanophosphor) that may be used in exemplary devices, where the spectral data for the phosphors show that the combinations should produce a device output having the rated or nominal color temperature. The colors of the phosphors represent the general appearance of the color emitted by each phosphor. As outlined above, however, these phosphors provide relatively broad emission spectra and may appear somewhat pastel in color (rather than more pure or saturated hues). For each phosphor, the percentage is the proportional amount of that phosphor with respect to the total amount of phosphors in the mixture (combination of all four phosphors in the example). As discussed more later, these percentage mixtures of the phosphors also cause light emitting devices using such mixtures to produce light that approaches or approximates the black body radiation spectrum for the rated color temperatures.

TABLE 4

Percentages of Phosphors in Mixtures for Selected Color Temperature Ranges

| Nominal CCT | % Blue | % Green | % Orange | % Red |
|---|---|---|---|---|
| 2700 | 10 | 21 | 25 | 45 |
| 3000 | 14 | 21 | 22 | 43 |
| 3500 | 17 | 25 | 27 | 30 |
| 4000 | 21 | 29 | 24 | 26 |
| 4500 | 28 | 27 | 22 | 22 |
| 5000 | 32 | 26 | 21 | 21 |
| 5700 | 37 | 23 | 19 | 21 |
| 6500 | 43 | 21 | 17 | 19 |

For convenience, each of the percentages in the table has been rounded to the nearest whole number.

A lighting device that has a material bearing one of the mixtures of Table 4 is expected to produce a white light output of a color temperature corresponding to the listed nominal color temperature, that is to say within the corresponding color temperature range of Table 1 and within the corresponding chromaticity quadrangle of Table 2. The combination of phosphors, however, is expected to also produce a white light that has a high quality spectral content, that is to say that approaches or corresponds to the black body radiation spectrum for the rated color temperature, over the 210 nm portion of the spectrum (e.g. from 450 nm to 660 nm). The percentages listed in Table 4 are given by way of example. Those skilled in the art will appreciate that even for the same four phosphors, some variation in the proportions/percentages of the different phosphors should produce similarly acceptable color/spectral performance in the light output of the device. Also, different phosphors will have different characteristic emission spectra and therefore would be mixed in different proportions.

Based on the emissions spectra data for the four selected phosphors, as represented by the spectral graphs of FIG. 4, and assuming relative percentages of the four phosphors as listed in Table 4, simulations/data analyses were done to determine the expected performance and to compare performance to the black body radiation spectra for the different nominal color temperatures. FIGS. 5 to 12 show graphs of various results of the simulations with respect to the phosphors/mixtures for the eight different color temperatures considered as examples herein.

The simulation data is normalized, so that the black body radiation spectrum and the radiation spectrum of the light emitting device both represent the same overall intensity of light output, to facilitate comparative analysis. For example, for a lighting device designed for an output at one of the rated color temperatures and a given output intensity, e.g. designed for a specified or rated number of lumens output, the black body radiation spectrum data for the rated color temperature is adjusted to represent the same output intensity.

Returning for a moment to FIG. 1, assume that the phosphors in the material at 16 in the fixture of the system 10 include the blue, green and orange emitting doped semiconductor nanophosphors and the red phosphor as discussed above relative to FIGS. 4 and 5A to 5C. With reference to Table 4, the mixture would contain 10% of the Blue doped semiconductor nanophosphor, 21% of the Green doped semiconductor nanophosphor, 25% of the Orange doped semiconductor nanophosphor and 45% of the Red semiconductor nanophosphor. As discussed earlier, the exemplary semiconductor LED chip formed by layers 13 and 15 (FIG. 2) is rated to emit near UV electromagnetic energy of a wavelength in the range of ≦460 nm, such as 405 nm in the illustrated example, which is within the excitation or absorption spectrum of each of the phosphors included in the mixture shown at 16. When excited, that combination of phosphors re-emits the various wavelengths of visible light represented by the blue, green, orange red lines in the graph of FIG. 4. However, the relative amount of each respective phosphor emission spectrum included in the device output spectrum corresponds to the percentage of the respective phosphor in the mixture the 2700° Kelvin rated color temperature of the device mixture as listed in Table 4. Since each phosphor is fully excited and emits a proportional amount of light corresponding to the percentage thereof in the mixture in phosphor bearing material 16, the combination or addition of the four phosphor emission spectrum in the fixture output produces "white" light, which for purposes of our discussion herein is light that is at least substantially white light. The white light emission from the solid state light emitting device (e.g. fixture) in system 10 exhibits a radiation spectrum corresponding to the wavy line in the example of FIG. 5A. Also, the light output of the fixture exhibits color temperature of 2738° Kelvin that is within the 2,725±145° Kelvin range for the nominal 2700° K color temperature.

Figure 5A:
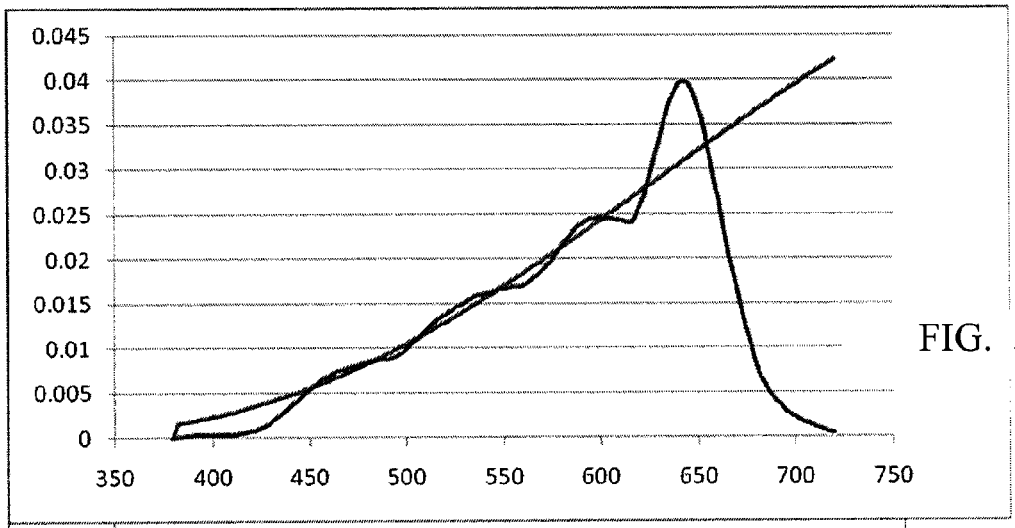
FIGS. 5A to 5C respectively are a spectral chart of the black body radiation spectrum and a device output radiation spectrum, a graph of absolute value of deviation as a percentage between the two spectra over a broad range, and a graph of absolute value of deviation as a percentage between the two spectra over the specific 210 nm range, for a 2700° Kelvin example.

FIG. 5A also shows the black body radiation spectrum for the rated color temperature 2700° Kelvin. The black body radiation spectrum has been normalized in that it is adjusted to represent a light intensity the same as the intensity of the light output of the solid state fixture in system 10. As shown, the radiation spectrum of the light output of the device tracks somewhat the black body radiation spectrum for the rated color temperature 2700° Kelvin, particularly over the 450 to 660 nm range, although there is some deviation between the black body radiation spectrum and the device output spectrum.

Figure 5B:
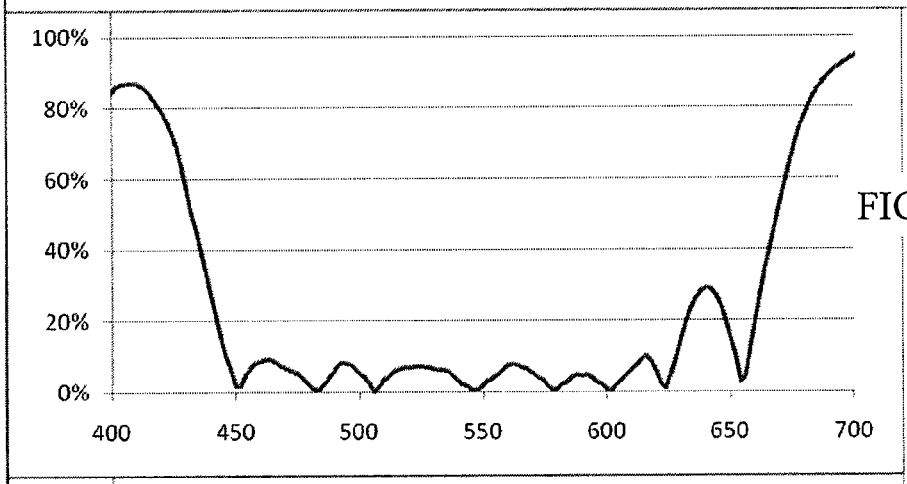
Figure 5C:
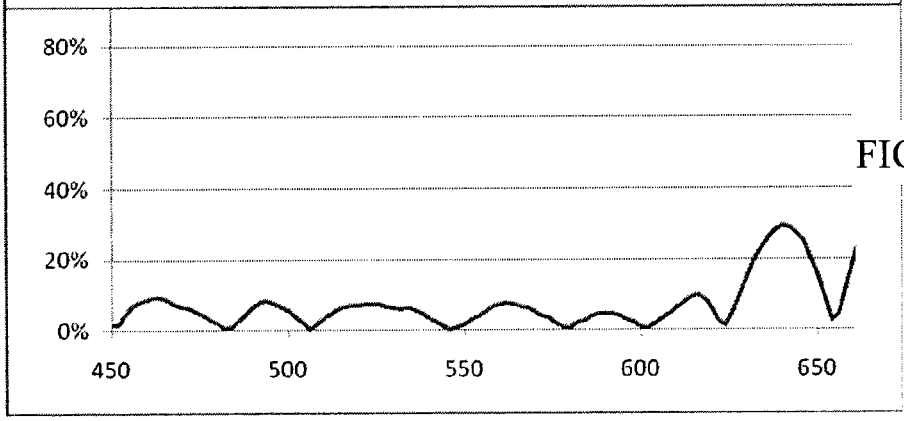
Figure 6A:
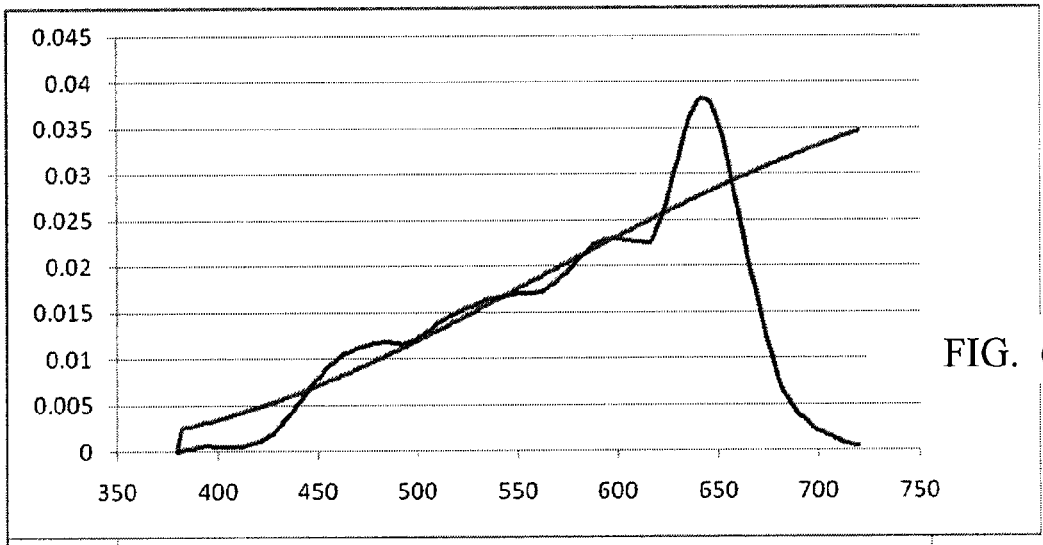
FIGS. 6A to 6C respectively are a spectral chart of the black body radiation spectrum and a device output radiation spectrum, a graph of absolute value of deviation as a percentage between the two spectra over a broad range, and a graph of absolute value of deviation as a percentage between the two spectra over the specific 210 nm range, for a 3000° Kelvin example.
Figure 6B:
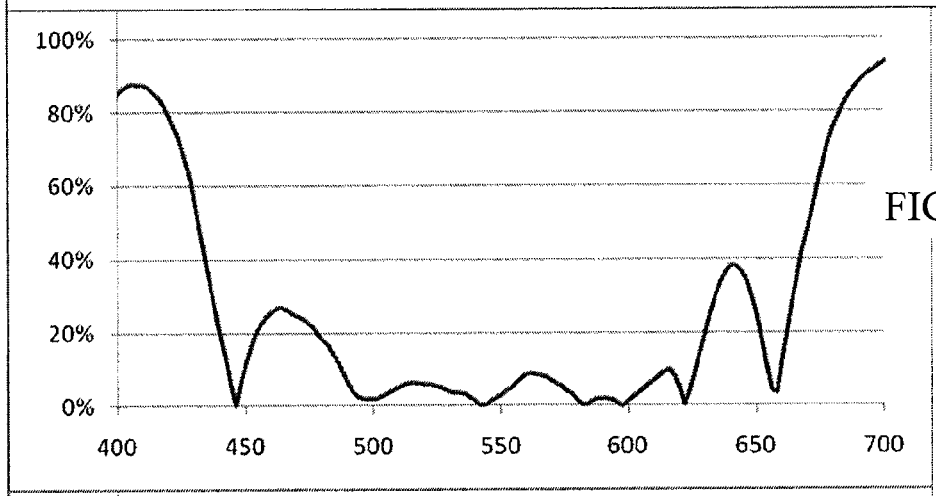
Figure 6C:
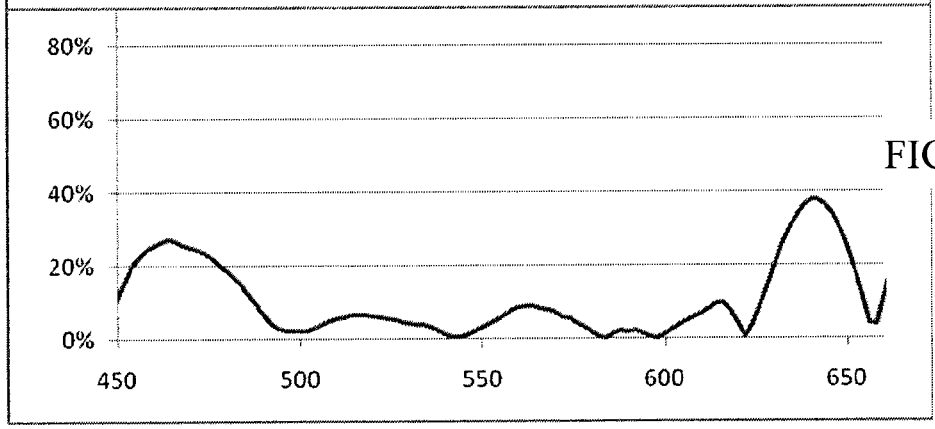
Figure 7A:
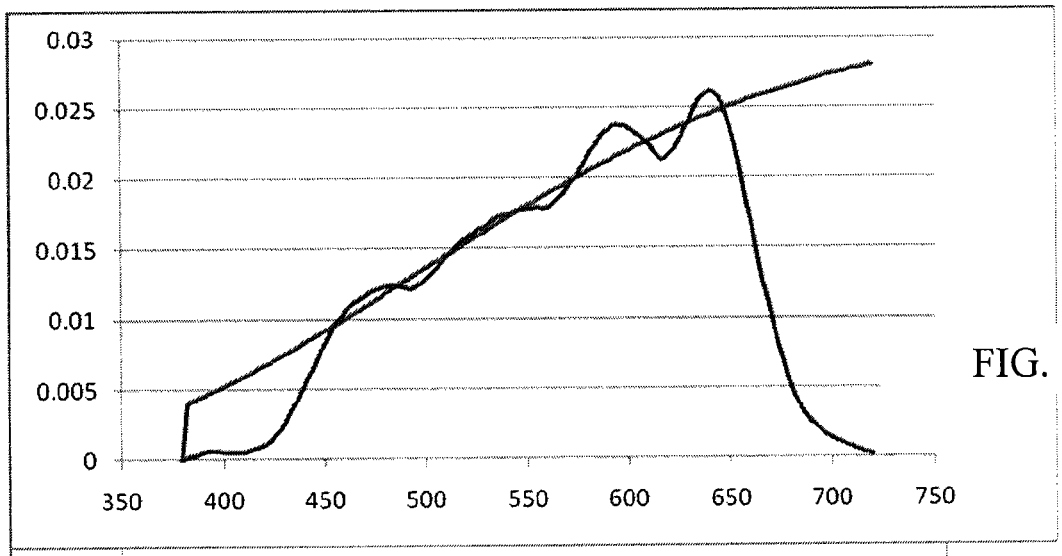
FIGS. 7A to 7C respectively are a spectral chart of the black body radiation spectrum and a device output radiation spectrum, a graph of absolute value of deviation as a percentage between the two spectra over a broad range, and a graph of absolute value of deviation as a percentage between the two spectra over the specific 210 nm range, for a 3500° Kelvin example.
Figure 7B:
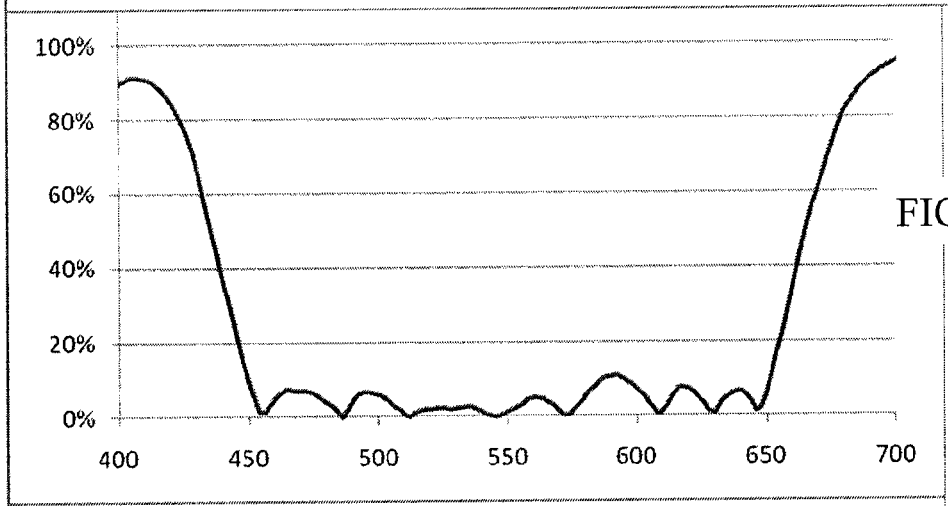
Figure 7C:
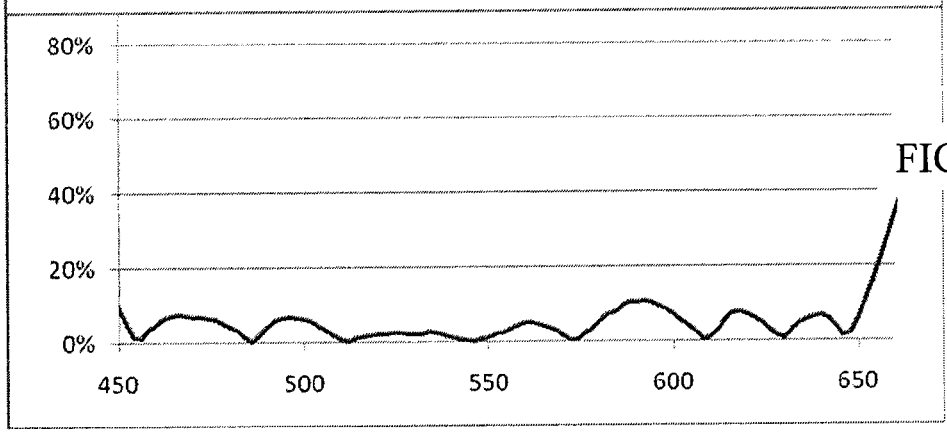
Figure 8A:
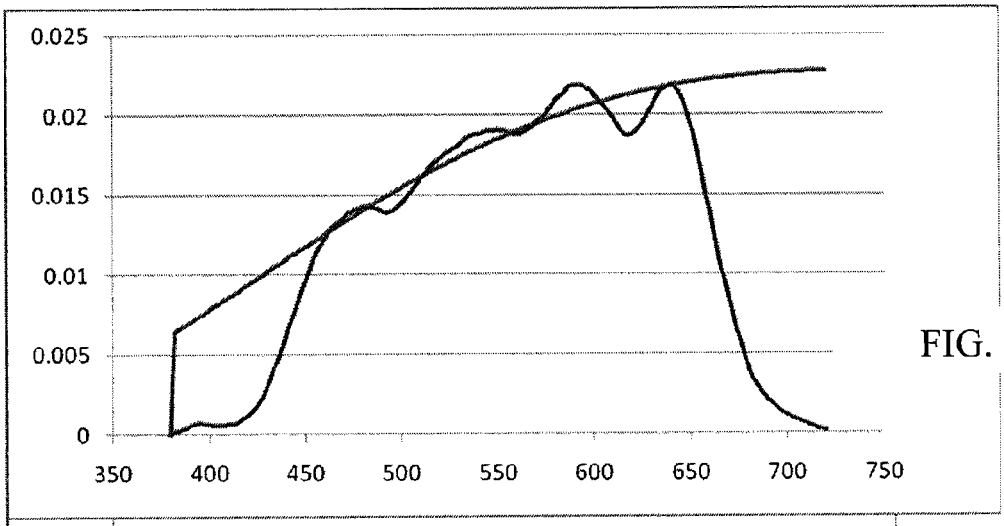
FIGS. 8A to 8C respectively are a spectral chart of the black body radiation spectrum and a device output radiation spectrum, a graph of absolute value of deviation as a percentage between the two spectra over a broad range, and a graph of absolute value of deviation as a percentage between the two spectra over the specific 210 nm range, for a 4000° Kelvin example.
Figure 8B:
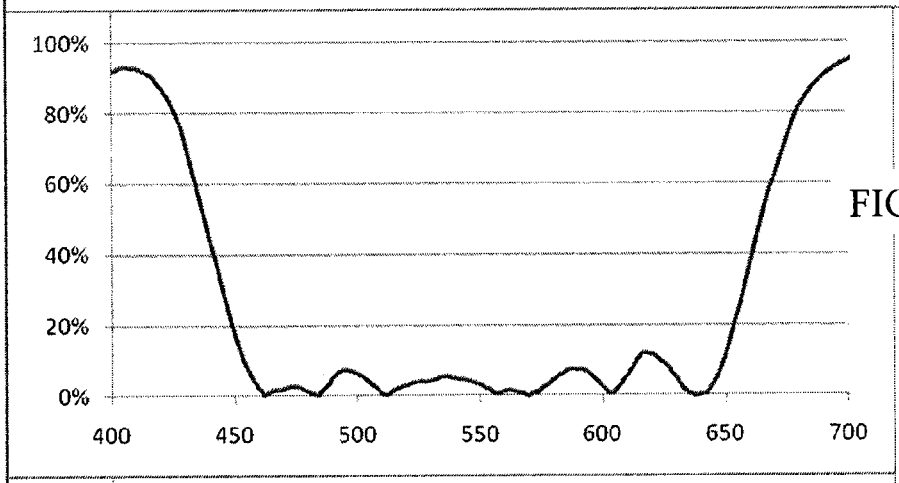
Figure 8C:
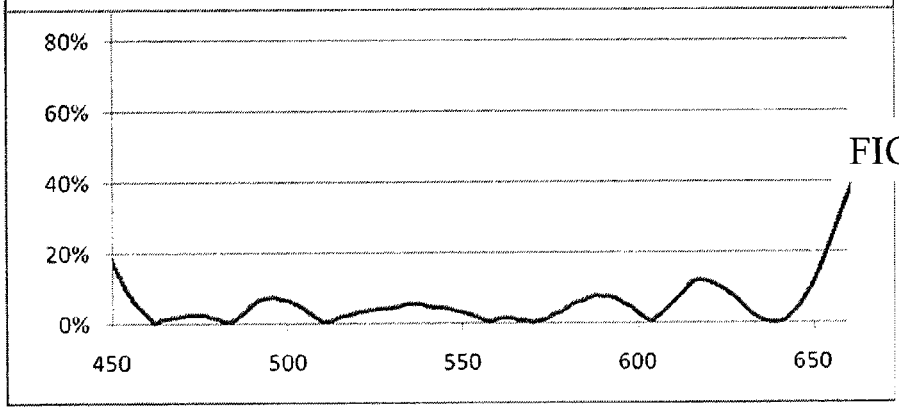
Figure 9A:
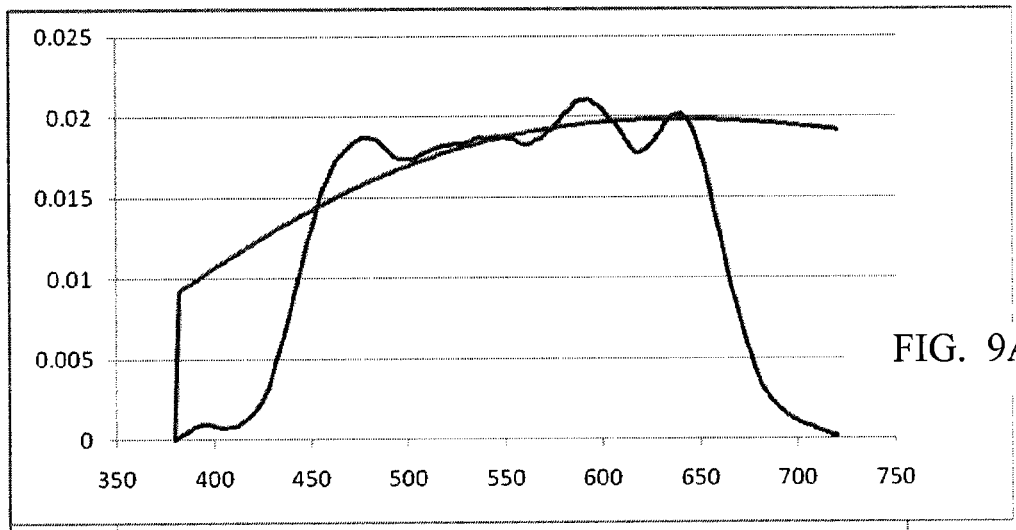
FIGS. 9A to 9C respectively are a spectral chart of the black body radiation spectrum and a device output radiation spectrum, a graph of absolute value of deviation as a percentage between the two spectra over a broad range, and a graph of absolute value of deviation as a percentage between the two spectra over the specific 210 nm range, for a 4500° Kelvin example.
Figure 9B:
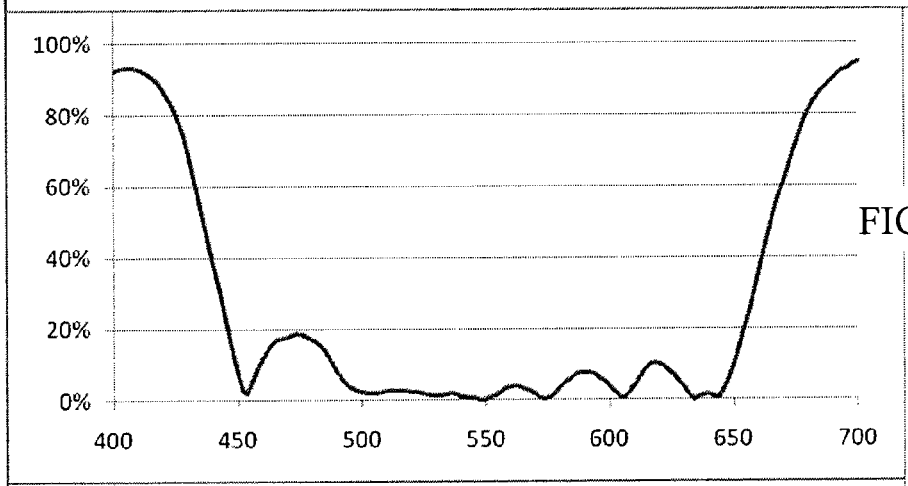
Figure 9C:
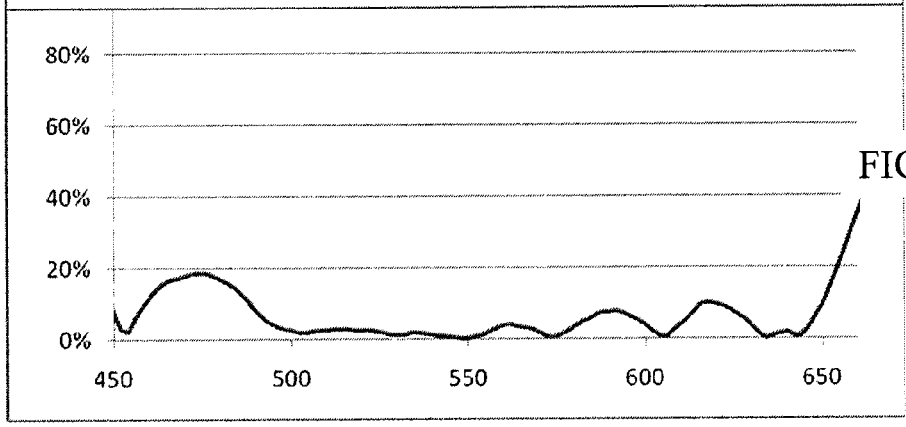
Figure 10A:
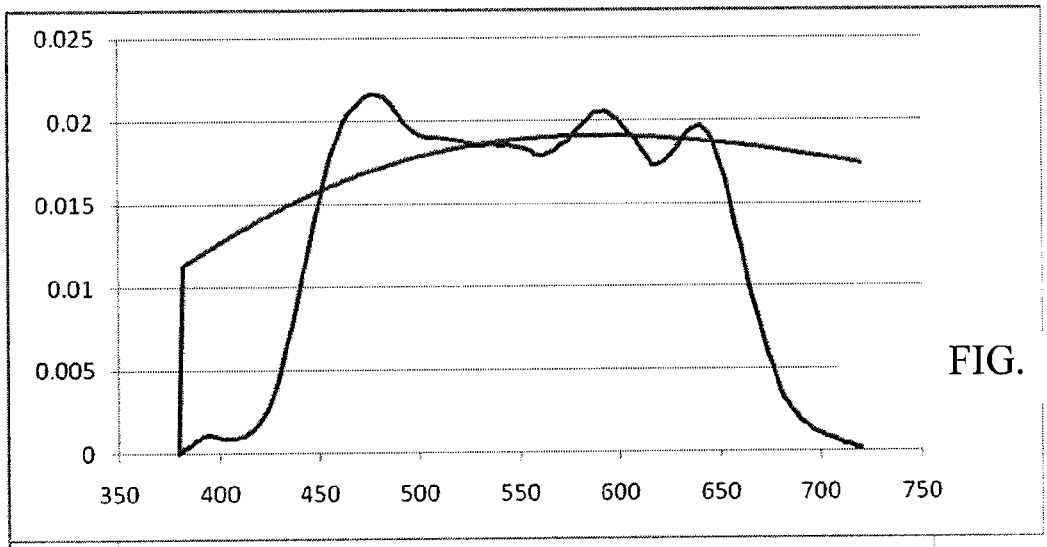
FIGS. 10A to 10C respectively are a spectral chart of the black body radiation spectrum and a device output radiation spectrum, a graph of absolute value of deviation as a percentage between the two spectra over a broad range, and a graph of absolute value of deviation as a percentage between the two spectra over the specific 210 nm range, for a 5000° Kelvin example.
Figure 10B:
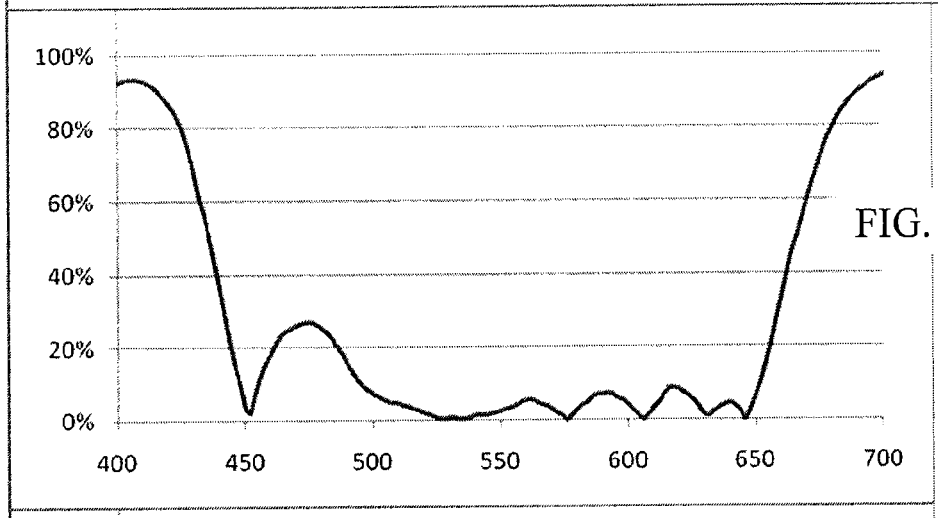
Figure 10C:
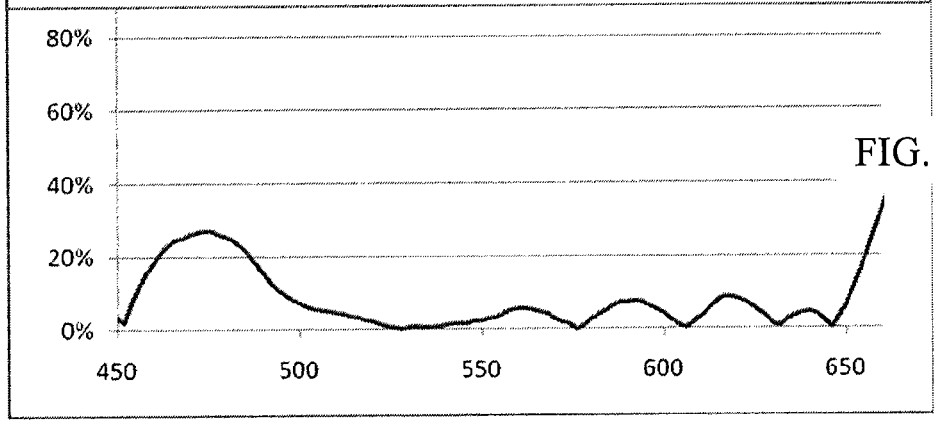
Figure 11A:
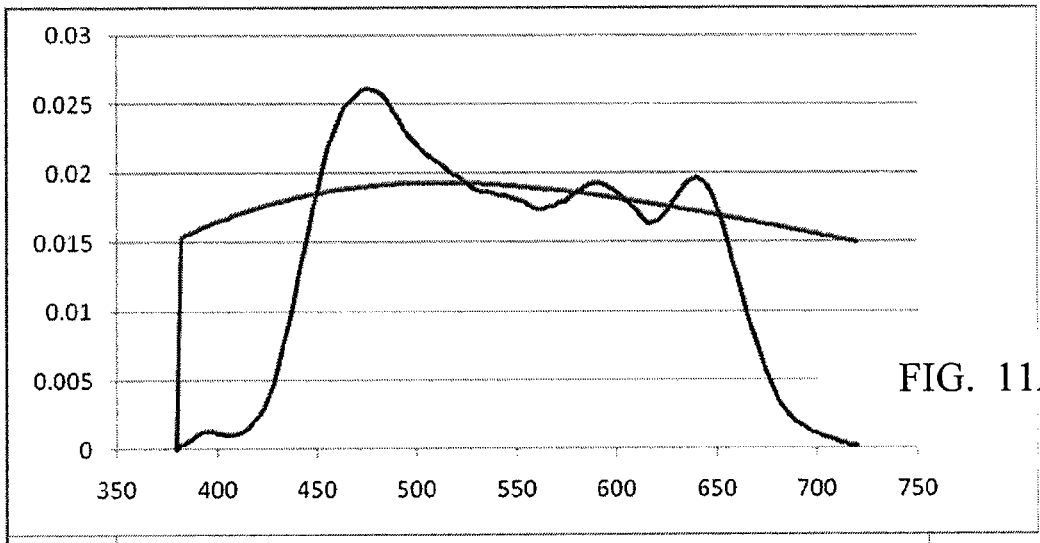
FIGS. 11A to 11C respectively are a spectral chart of the black body radiation spectrum and a device output radiation spectrum, a graph of absolute value of deviation as a percentage between the two spectra over a broad range, and a graph of absolute value of deviation as a percentage between the two spectra over the specific 210 nm range, for a 5700° Kelvin example.
Figure 11B:
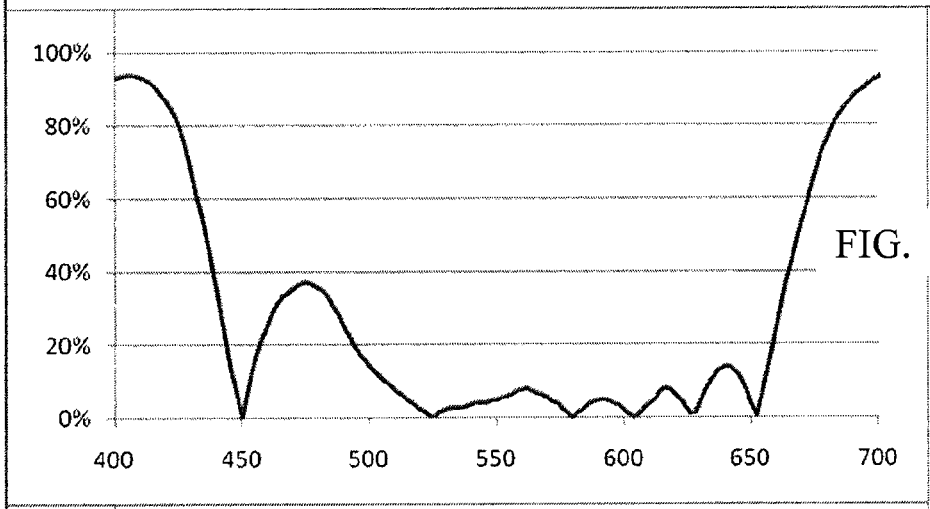
Figure 11C:
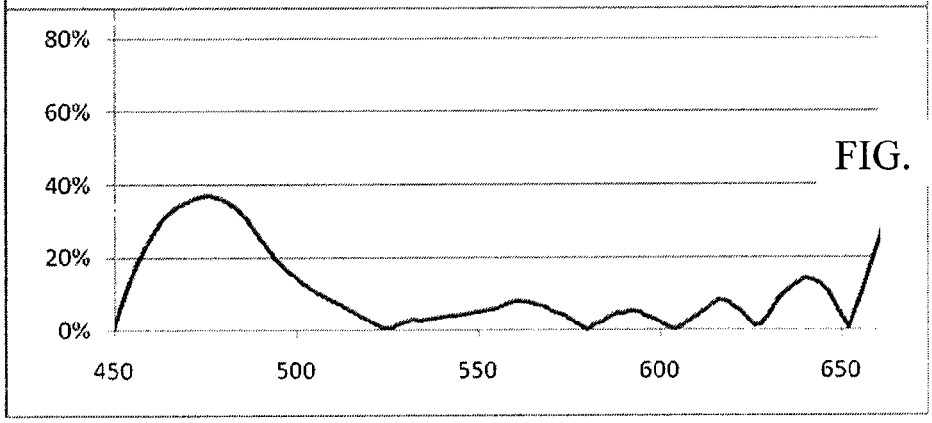
Figure 12A:
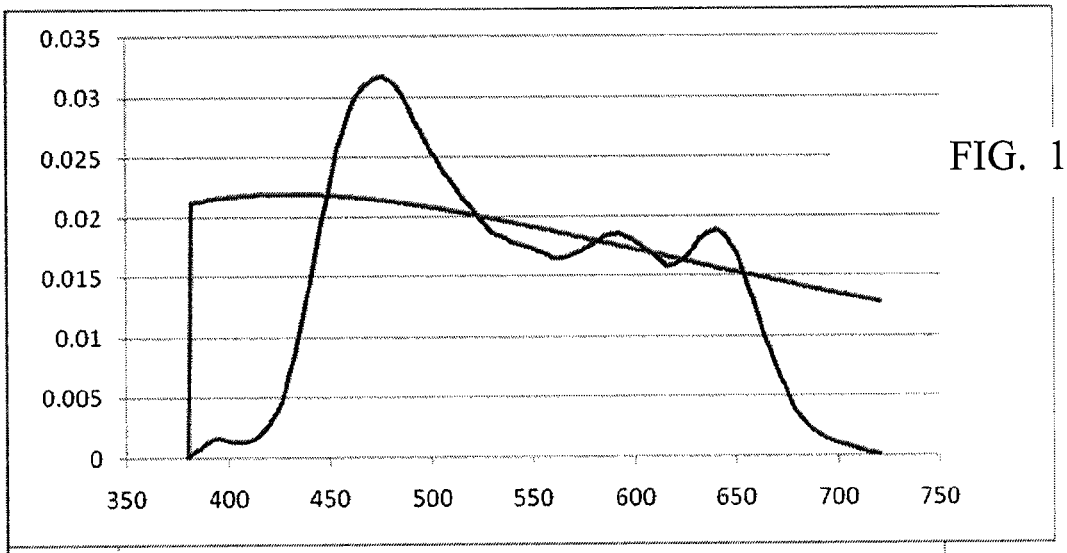
FIGS. 12A to 12C respectively are a spectral chart of the black body radiation spectrum and a device output radiation spectrum, a graph of absolute value of deviation as a percentage between the two spectra over a broad range, and a graph of absolute value of deviation as a percentage between the two spectra over the specific 210 nm range, for a 6500° Kelvin example.
Figure 12B:
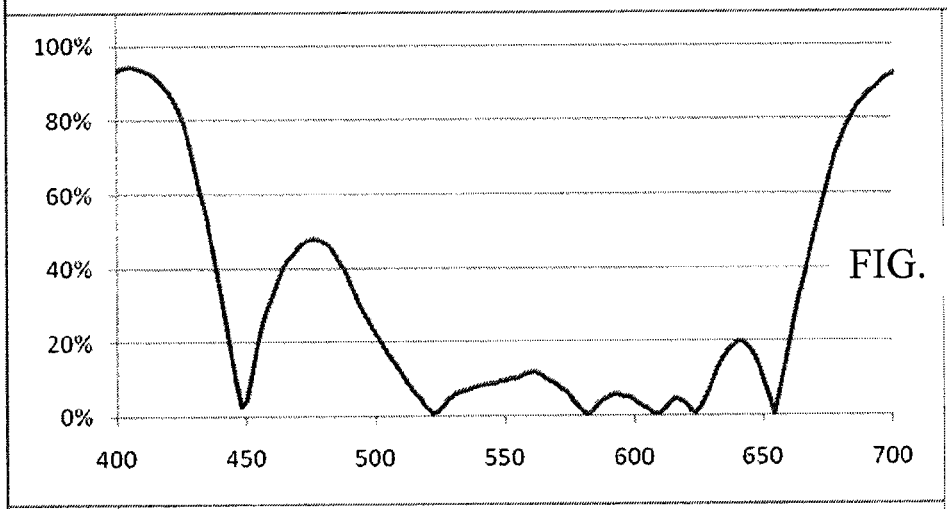
Figure 12C:
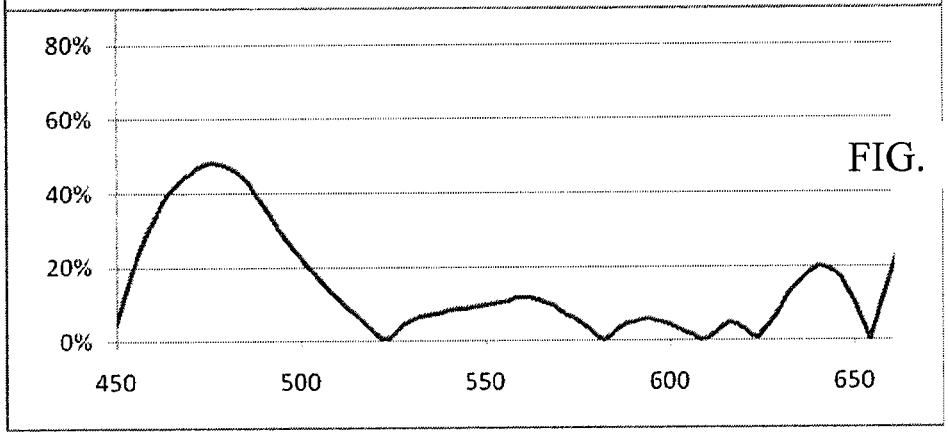

FIGS. 5B and 5C show deviation between the black body radiation spectrum and the spectrum of the light emitting device, e.g. the fixture of the system 10, albeit over different portions or ranges of the visible light spectrum. These drawings show the percentage of the absolute value of the deviation (absolute value of the difference between the device output spectrum and the normalized black body radiation spectrum, as a percent of the normalized black body radiation spectrum). FIG. 5B shows the deviation over the full range of the output radiation spectrum of the device, 400 to 700 nm in the example. However, as discussed earlier, the region of particular interest for approximation of the black body radiation spectrum is a 210 nm range, such as the 450 to 660 nm range. Hence, FIG. 5C shows the deviation over 450 to 660 nm range.

The graphs/data may be statistically analyzed and compared in a number of ways to appreciate spectral performance. Although other statistical measures of the degree to which the simulated device output spectrum approaches or approximates the relevant portion of the black body radiation spectrum for the rated color temperature, we have used deviation between the two spectra and various metrics related to the deviation.

In the example of FIGS. 5A to 5C, for the example configured for a nominal or rated CIE color temperature (CCT) of 2700, the average of the absolute value of the deviation of the device spectrum from the black body radiation spectrum was 7%, over the 450-660 nm range. Over that same range, the maximum absolute value of the deviation of the device spectrum from the black body radiation spectrum was 29%. As shown by the graph in FIG. 5C, this occurred at the peak in deviation around the wavelength 640 nm, which corresponds to the spectral peak of the device output shown in FIG. 5A. From a CRI analysis of the spectral data for the 2700° Kelvin example, it was also determined that the output light of such a device should exhibit a CRI at or about 98.

The same simulations and analyses using the phosphor percentages (Table 4) for the other rated color temperatures were performed. FIGS. 6 to 12 are similar to FIG. 5, except that FIGS. 6 to 12 show the corresponding graphs for the other nominal color temperatures discussed herein.

Table 5 below shows the various statistical measures of the difference or deviation between the device output radiation spectrum and the black body radiation spectrum, for the eight nominal color temperatures represented by the graphs in FIGS. 5-12. The exemplary simulation data and thus the deviation values and averages in the table are based on data points or values for the black body and device radiation spectra for every other nm wavelength (every 2 nm) over the relevant spectral range. However, since the metrics use maximum absolute value deviation and an average, it is believed that analyses based on different numbers/widths of spectral data points (e.g. every nm, every 5 nm, every 10 nm, etc.) would produce similar results.

TABLE 5

Deviation (Δ) Metrics for Devices Rated at Nominal Color Temperatures

| Nominal CCT | Avg. \|Δ %\| Over 450-660 nm | Max. \|Δ %\| Over 450-660 nm |
|---|---|---|
| 2700 | 7 | 29 |
| 3000 | 11 | 38 |
| 3500 | 5 | 34 |
| 4000 | 5 | 37 |
| 4500 | 6 | 36 |
| 5000 | 8 | 33 |
| 5700 | 11 | 37 |
| 6500 | 14 | 48 |

Approximation of the black body radiation spectrum is intended to produce a high quality spectral content. As noted earlier, although other measures may be used or developed, the current standard metric of spectral content for lighting applications is CRI. Hence, the CRI for each example also was calculated from the spectral data. Table 6 below lists specific expected color temperature and CRI values for the light emitting devices using the above discussed phosphor mixtures to produce white light outputs of the rated color temperatures.

TABLE 6

Color Temperatures and CRI Results for Devices Rated at Nominal Color Temperatures

| Nominal CCT (° Kelvin) | Output Color Temp. (° Kelvin) | Device Output CRI |
|---|---|---|
| 2700 | 2738 | 98 |
| 3000 | 3050 | 94 |
| 3500 | 3461 | 93 |
| 4000 | 3997 | 90 |
| 4500 | 4547 | 91 |
| 5000 | 4936 | 90 |

TABLE 6-continued

Color Temperatures and CRI Results for Devices Rated at Nominal Color Temperatures

| Nominal CCT (° Kelvin) | Output Color Temp. (° Kelvin) | Device Output CRI |
|---|---|---|
| 5700 | 5679 | 90 |
| 6500 | 6759 | 86 |

An actual prototype was built using the four phosphors and a mixture thereof for a 2700° Kelvin output. For the prototype, the percentages were approximately 11% of the Blue, 23% of the Green, and 27% of the Orange, for the doped semiconductor nanophosphors; and 38% of the red semiconductor nanophosphor. The prototype produced a light output CCT of 2839° Kelvin (within the 2725±145° Kelvin range).

Figure 13A:
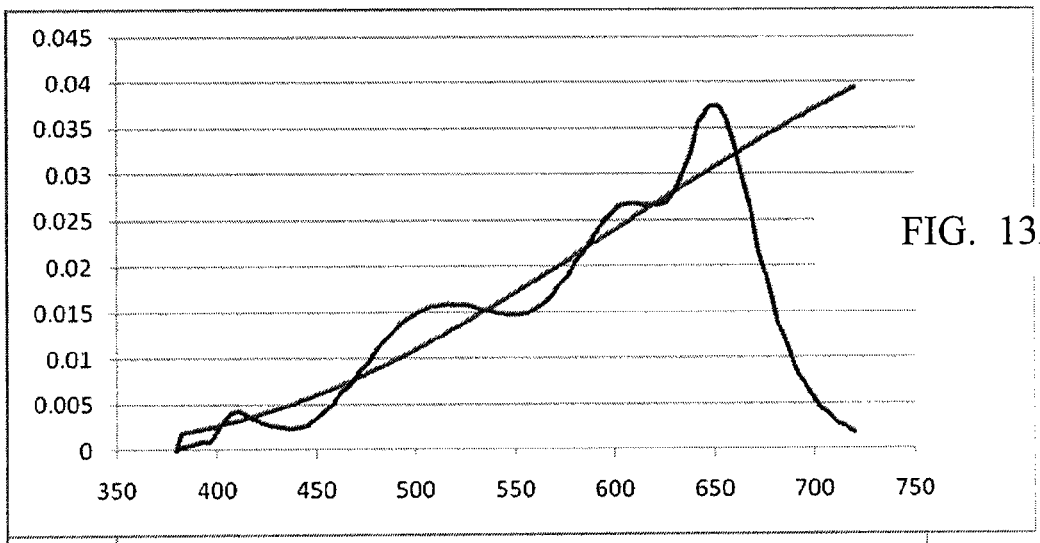
FIGS. 13A to 13C respectively are a spectral chart of the black body radiation spectrum and a device output radiation spectrum, a graph of absolute value of deviation as a percentage between the two spectra over a broad range, and a graph of absolute value of deviation as a percentage between the two spectra over the specific 210 nm range, for a prototype lighting device rated for 2700° Kelvin output.
Figure 13B:
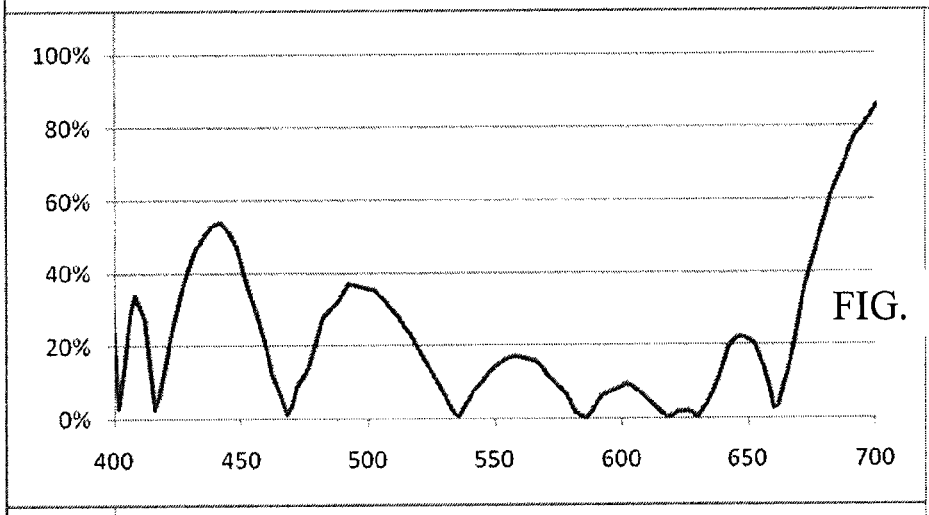
Figure 13C:
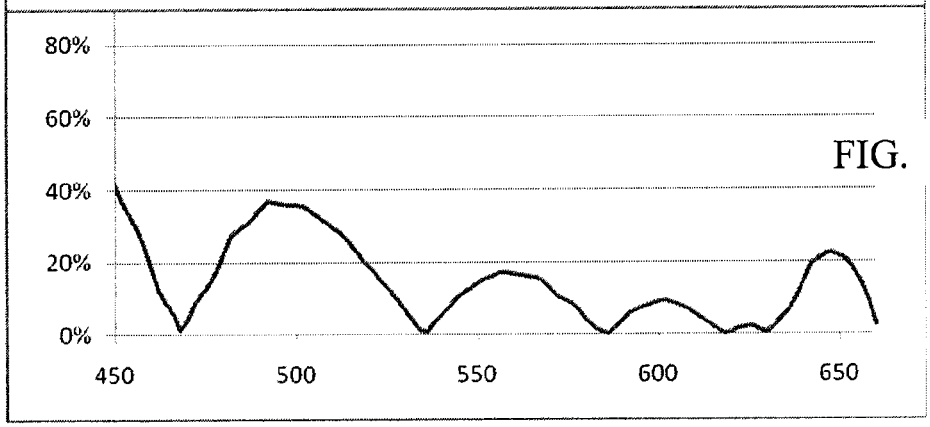

FIGS. 13A to 13C are spectral and deviation graphs for the 2700° Kelvin prototype similar to the simulation graphs of FIGS. 5A to 5C. The device radiation spectrum (wavy line) in FIG. 13A is that of the prototype. The black body radiation spectrum in FIG. 13A is that for 2700° Kelvin, the same as in FIG. 5A. Again, the black body radiation spectrum has been normalized in that it is adjusted to represent a light intensity the same as the intensity of the light output of the solid state fixture, in this case, the output of the prototype. As shown, the radiation spectrum of the light output of the device tracks somewhat the black body radiation spectrum for the rated color temperature 2700° Kelvin, particularly over the 450 to 660 nm range, although there is some deviation between the black body radiation spectrum and the device output spectrum.

FIGS. 13B and 13C show deviation between the black body radiation spectrum and the spectrum of the prototype light emitting device, albeit over different portions or ranges of the visible light spectrum. These drawings show the percentage of the absolute value of the deviation (absolute value of the difference between the device output spectrum and the normalized black body radiation spectrum, as a percent of the normalized black body radiation spectrum). FIG. 13B shows the deviation over the full range of the output radiation spectrum of the device, 400 to 700 nm in the example. However, as discussed earlier, the region of particular interest for approximation of the black body radiation spectrum is a 210 nm range, such as the 450 to 660 nm range. Hence, FIG. 13C shows the deviation over 450 to 660 nm range.

Over the 210 nm range from 450 nm to 660 nm, the average of the absolute value of deviation of the device output radiation spectrum from the black body radiation spectrum for 2700° Kelvin was 15%. Over that range, the maximum deviation between the output radiation spectrum and the corresponding black body radiation spectrum was 42%. Also, the light output of the prototype exhibited a CRI of 91.

From the simulation and the prototype data, the inventors propose that a high quality spectral content produced by a solid state lighting device, using phosphors in the manner and/or exemplary percentages described would exhibit (i) a maximum absolute value of the deviation of the device spectrum from the black body radiation spectrum of no more than 50% (deviates no more than ±50%) from a black body radiation spectrum for the rated color temperature for the device over at least 210 nm of the visible light spectrum; and (ii) would have an average absolute value of deviation of no more than 15% from the black body radiation spectrum for the rated color temperature for the device over at least the 210 nm of the visible light spectrum.

However, from the data, it should be apparent that some lighting devices may be able to meet even stricter performance standards, although perhaps not at all of the exemplary rated color temperatures.

Hence, using the simulation results from Tables 5 and 6 for the color temperature range of 2700-5700° Kelvin to define the outer boundaries of acceptable spectral performance, which is slightly larger than that achieved by 5700° Kelvin but does not encompass the outlier example at 6500° Kelvin, another set of spectral requirements would be for the device output spectrum to exhibit (i) absolute value of deviation of no more than 42% from a black body radiation spectrum for the rated color temperature for the device (deviates no more than ±42%) over at least 210 nm of the visible light spectrum and (ii) would have an average absolute value of deviation of no more than 12% from the black body radiation spectrum for the rated color temperature for the device over at least the 210 nm of the visible light spectrum. Such a device output would provide a CRI of 87 or better.

Using the actual simulation results from Tables 5 and 6 for the color temperature range of 2700-5700° Kelvin to define the outer boundaries of acceptable spectral performance, another set of spectral requirements would be for the device output spectrum to exhibit (i) a maximum absolute deviation of no more than 37% (deviates no more than ±37%) from a black body radiation spectrum for the rated color temperature for the device over at least 210 nm of the visible light spectrum; and (ii) would have an average absolute value of deviation of no more than 11% from the black body radiation spectrum for the rated color temperature for the device over at least the 210 nm of the visible light spectrum. Such a device output would provide a CRI of 90 or better.

In Table 5, the best 5 average deviations (Avg. |Δ%|) were for 2700 (7), 3500 (5), 40000 (5), 4500, (6) and 5000 (8). The examples give an average range for the averages of 5-8%. For these same color temperatures the largest maximum absolute value of deviation was 37% (at 4000). Hence, using that more limited best of five results for the average, from Table 5, another set of spectral requirements would be for the device output spectrum to exhibit (i) maximum absolute value of deviation of no more than 37% (deviates no more than ±37%) from a black body radiation spectrum for the rated color temperature for the device over at least 210 nm of the visible light spectrum; but (ii) would have an average absolute value of deviation of no more than 8% from the black body radiation spectrum for the rated color temperature for the device over at least the 210 nm of the visible light spectrum. From those same best five data points, the data in Table 6 shows that the a device output would provide a CRI of 90 or better.

Returning again to FIG. 1, the system 10 provides a "remote" implementation of the semiconductor nanophosphors in that the semiconductor nanophosphors are deployed outside of the package enclosing the actual semiconductor chip or chips and thus are apart or remote from the semiconductor chip(s), that is to say, in the optical processing element or apparatus 12, 14, 16 in this first example. The remote semiconductor nanophosphors in the material at 16 may be provided in or about the optic 12 in any of a number of different ways, such as along any suitable portion of the inner reflective surface 29 of the macro reflector 27, in the form of a container or coating. Several different locations of the material with the semiconductor nanophosphors are shown and described with regard to later examples. In the first example of FIG. 1, the container 14 extends across a portion of the volume within the reflector 27 across the path of energy emissions from the source 11 through the optic 12.

At least some semiconductor nanophosphors degrade in the presence of oxygen, reducing the useful life of the semiconductor nanophosphors. Hence, it may be desirable to encapsulate the semiconductor nanophosphor bearing material 16 in a manner that blocks out oxygen, to prolong useful life of the semiconductor nanophosphors. In the example of FIG. 1, the container 14 therefore may be a sealed glass container, the material of which is highly transmissive and exhibits a low absorption with respect to visible light and the relevant wavelength(s) of near UV or UV energy of the particular source 11. The interior of the container 14 is filled with the semiconductor nanophosphor bearing material 16. Any of a number of various sealing arrangements may be used to seal the interior once filled, so as to maintain a good oxygen barrier and thereby shield the semiconductor nanophosphors from oxygen.

Figure 14:
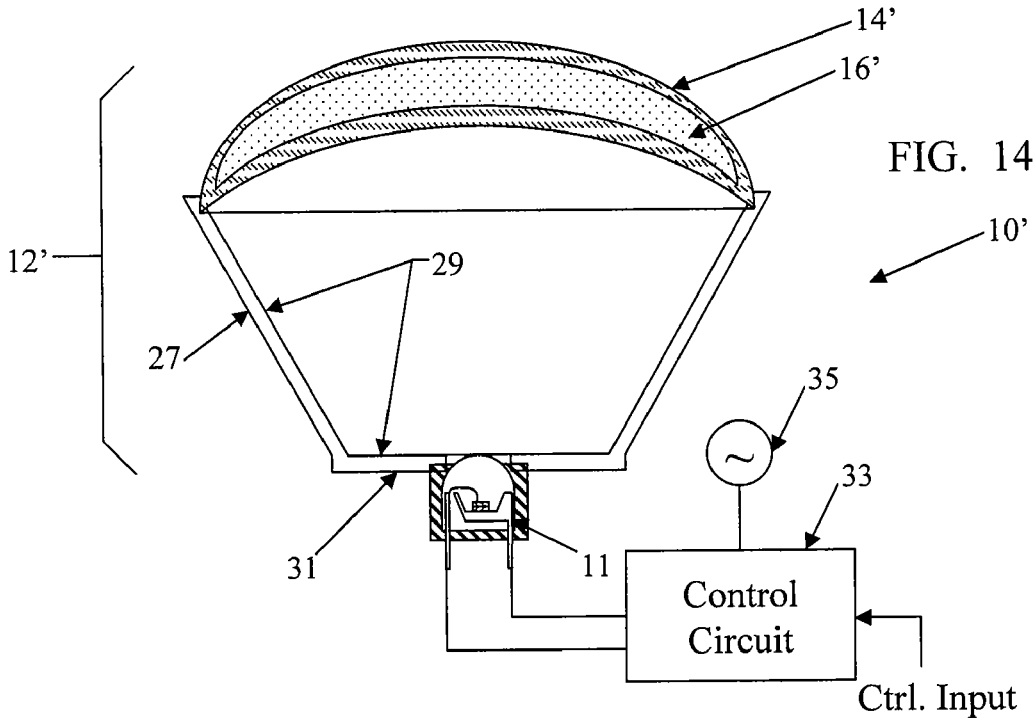
FIG. 14 illustrates an example of a white light emitting system, similar to that of FIG. 1, but using a different configuration/position for the container for the phosphor bearing material.

The container 14 and the semiconductor nanophosphor bearing material 16 may be located at any convenient distance in relation to the proximal end 31 of the reflector 27 and the solid state source 11. For example, the container 14 and the semiconductor nanophosphor bearing material 16 could be located adjacent to the proximal end 31 of the reflector 27 (adjacent to that part of the reflective surface 29) and adjacent to the solid state source 11. Alternatively, as shown by the system 10' of FIG. 14, the container 14' and the nanophosphor bearing material 16' in the optic 12' could be located at or near the distal end of the reflector 27. The container may also have a wide variety of shapes. In the example of FIG. 1, the container 14 is relatively flat and disk-shaped. In the example of FIG. 14, the container 14' has a convex outer curvature, although it could be convex or concave. The inner surface of the container 14' facing toward the solid state source 11 and the reflective surface 29 may be flat, concave or convex (as shown). Those skilled in the art will also recognize that the optic 12 or 12' could include a variety of other optical processing elements, such as a further reflector, one or more lenses, a diffuser, a collimator, etc.

Other container arrangements are contemplated. For example, the reflector 27 might serve as the container. In such an arrangement, the distal end of the reflector would have a transmissive optical aperture for energy to enter from the LED 11, although the material would seal the reflector at that point. The distal end of the reflector 27 might then be sealed to form the container by means of a transmissive plate, lens or diffuser, for example, formed of glass. A glass container might be used that is shaped like the reflector 27 but has reflective coatings on the appropriate interior surfaces 29. In these cases, the material bearing the nanophosphors would fill substantially all of the interior volume of the reflector 27.

The lighting system 10 (or 10') also includes a control circuit 33 coupled to the LED type semiconductor chip in the source 11, for establishing output intensity of electromagnetic energy output of the LED type source 11. The control circuit 33 typically includes a power supply circuit coupled to a voltage/current source, shown as an AC power source 35. Of course, batteries or other types of power sources may be used, and the control circuit 33 will provide the conversion of the source power to the voltage/current appropriate to the particular one or more LEDs 11 utilized in the system 10 (or 10'). The control circuit 33 includes one or more LED driver circuits for controlling the power applied to one or more sources 11 and thus the intensity of energy output of the source. Intensity of the phosphor emissions are proportional to the intensity of the energy pumping the nanophosphors, therefore control of the LED output controls the intensity of the light output of the fixture. The control circuit 33 may be responsive to a number of different control input signals, for example to one or more user inputs as shown by the arrow in FIG. 1, to turn power ON/OFF and/or to set a desired intensity level for the white light output provided by the system 10 or 10'.

In the exemplary arrangement of the optic 12 (or 12'), near UV light energy from the 405 nm solid state source 11 enters the interior volume of the reflector 27 and passes through the outer glass of the container 14 (or 14') into the material 16 (or 16') bearing the semiconductor nanophosphors. Much of the near UV emissions enter the container directly, although some reflect off of the surface 29 and into the container. Within the container 14 or 14', the 405 nm near UV energy excites the semiconductor nanophosphors in material 16 or 16' to produce light that is at least substantially white, that exhibits a CRI of 85 or higher and that exhibits color temperature in one of the specified ranges (see Table 1 above). Light resulting from the semiconductor nanophosphor excitation, essentially absorbed as near UV energy and reemitted as visible light of the wavelengths forming the desired white light, passes out through the material 16 or 16' and the container 14 or 14' in all directions. Some light emerges directly out of the optic 12 as represented by the undulating arrows in FIG. 1. However, some of the white light will also reflect off of various parts of the surface 29. Some light may even pass through the container and semiconductor nanophosphor material again before emission from the optic.

In the orientation illustrated in FIGS. 1 and 14, white light from the semiconductor nanophosphor excitation, including any white light emissions reflected by the surface 29 are directed upwards, for example, for lighting a ceiling so as to indirectly illuminate a room or other habitable space below the fixture. The orientation shown, however, is purely illustrative. The optic 12 or 12' may be oriented in any other direction appropriate for the desired lighting application, including downward, any sideways direction, various intermediate angles, etc. Also, the examples of FIGS. 1 and 14 utilize relatively flat reflective surfaces for ease of illustration. Those skilled in the art will recognize, however, that the principles of those examples are applicable to optics of other shapes and configurations, including optics that use various curved reflective surfaces (e.g. hemispherical, semi-cylindrical, parabolic, etc.).

The nanophosphor-centric solid state lighting technology discussed herein, using a material bearing one or more nanophosphors dispersed therein, may be adapted to a variety of different fixture optic structures with various types of reflectors, diffusers or the like. Several additional fixture examples are discussed in some detail in publications US 2009-0296368 A1 and US 2009-0295266 A1, and in pending U.S. patent application Ser. Nos. 12/609,523 titled "HEAT SINKING AND FLEXIBLE CIRCUIT BOARD, FOR SOLID STATE LIGHT FIXTURE UTILIZING AN OPTICAL CAVITY," and 12/629,614 titled "LIGHT FIXTURE USING UV SOLID STATE DEVICE AND REMOTE SEMICONDUCTOR NANOPHOSPHORS TO PRODUCE WHITE LIGHT," the disclosures of all of which are incorporated entirely herein by reference.

Although fixtures without reflectors may use the remote nanophosphors, the examples specifically discussed above relative to FIGS. 1 and 14 include a reflector 27 forming or as part of the optic 12. Various types of reflectors may be used. It is also contemplated that the reflector might be configured to form an optical integrating cavity. In such an implementation of the fixture, the reflector receives and diffusely reflects the input energy and/or the visible light emitted by the doped semiconductor nanophosphors to produce an integrated light output. The emission spectrum of the output includes visible light of the emission spectra of the various nanophosphors dispersed in the material. The container may be coupled to the cavity in different ways. For example, the container could be at or near the LED inputs to the cavity, at the output aperture of the cavity, at a location on the reflective interior surface forming the cavity. It may be helpful to consider an optical cavity example, in somewhat more detail.

Figure 15:
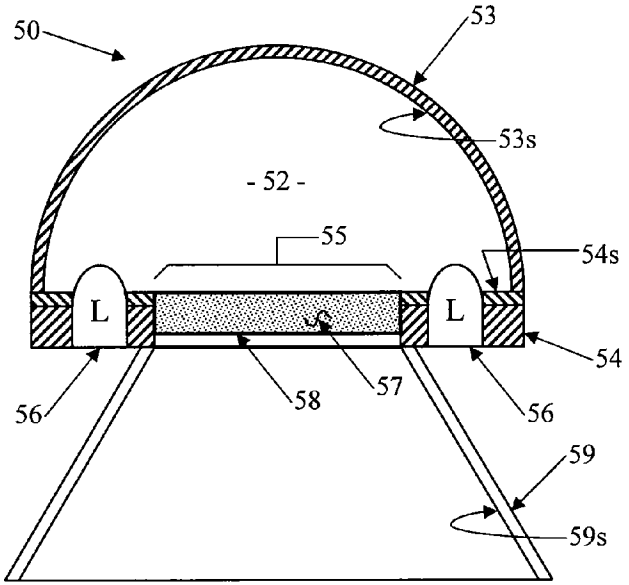
FIG. 15 is a cross section of a light fixture for a general lighting application, using solid state light emitters, an optical integrating cavity, a deflector or concentrator and a liquid or gas containing the phosphors.

FIG. 15 illustrates an example of a lighting fixture having LED type solid state light sources, an optical integrating chamber and a liquid containing the semiconductor nanophosphors. At a high level, the solid state lighting fixture 50 of FIG. 15 includes a chamber, in this example, an optical integrating cavity 52 formed by a dome 53 and a plate 54. The cavity 52 has a diffusely reflective interior surface 53*s* and/or 54*s* and a transmissive optical passage 55. The lighting apparatus 50 also includes a source of light of a first emission spectrum of sufficient light intensity to pump the phosphors to provide adequate output light for a general lighting application, in this example, two or more solid state light sources 56. The lighting fixture 50 utilizes semiconductor nanophosphors in a liquid 57 within a container 58, for producing a wavelength shift of at least some light from the source(s) 56 to produce a desired color characteristic in the processed light emitted from the optical passage or aperture 55 of the chamber 52. In this example, the container 58 with the nanophosphor bearing material is the apparatus or optical element for producing visible light in response to electromagnetic energy from a solid state source(s) 56 in the fixture 50. The intensity of light produced by the light source, e.g. the solid state light emitter(s) 56, is sufficient for the light output of the device 50 to support the general lighting application.

For convenience, the lighting device or fixture in this example is shown emitting the light downward from the aperture 55, possibly via an additional optical processing element such as a deflector or concentrator (e.g. deflector 59 in FIG. 1). However, the fixture 50 may be oriented in any desired direction to perform a desired general lighting application function. The aperture or a further optical processing element may provide the ultimate output of the device 50 for a particular general lighting application. As discussed in detail with regard to FIG. 15, but applicable to other integrating cavity examples like present FIG. 17 and/or in several of the above-incorporated applications and publications, circular or hemispherical shapes are shown and discussed most often for convenience, although a variety of other shapes may be used.

Hence, as shown in FIG. 15, an exemplary general lighting fixture 50 includes an optical integrating cavity 52 having a reflective interior surface 53*s*, 54*s*. The cavity 52 is a diffuse optical processing element used to convert a point source input, typically at an arbitrary point not visible from the outside, to a virtual source. At least a portion of the interior surface of the cavity 52 exhibits a diffuse reflectivity.

The cavity 52 may have various shapes. The illustrated cross-section would be substantially the same if the cavity is hemispherical or if the cavity is semi-cylindrical with a lateral cross-section taken perpendicular to the longitudinal axis of the semi-cylinder. For purposes of the discussion, the cavity 52 in the fixture 50 is assumed to be hemispherical or nearly hemispherical. In such an example, a hemispherical dome 53 and a substantially flat cover plate or mask 54 form the optical cavity 52. Although shown as separate elements, the dome and plate may be formed as an integral unit. The plate is shown as a flat horizontal member, for convenience, although curved or angled configurations may be used. At least the interior facing surface(s) 53*s* of the dome 53 is highly diffusely reflective, so that the resulting cavity 52 is highly diffusely reflective with respect to the radiant energy spectrum produced by the fixture 50. The interior facing surface(s)

54*s* of the plate 54 is reflective, typically specular or diffusely reflective. In the example, the dome 53 itself is formed of a diffusely reflective material, whereas the plate 54 may be a circuit board or the like on which a coating or layer of reflective material is added or mounted to form the reflective surface 54*s*.

It is desirable that the diffusely reflective cavity surface(s) have a highly efficient reflective characteristic, e.g. a reflectivity equal to or greater than 90%, with respect to the relevant wavelengths. The entire interior surface (surfaces 53*s*, 54*s* of the dome and plate) may be diffusely reflective, or one or more substantial portions may be diffusely reflective while other portion(s) of the cavity surface may have different light reflective characteristics. In some examples, one or more other portions are substantially specular or are semi or quasi specular.

The elements 53 and 54 of the cavity 52 may be formed of a diffusely reflective plastic material, such as a polypropylene having a 97% reflectivity and a diffuse reflective characteristic. Such a highly reflective polypropylene is available from Ferro Corporation-Specialty Plastics Group, Filled and Reinforced Plastics Division, in Evansville, Ind. Another example of a material with a suitable reflectivity is SPECTRALON. Alternatively, each element of the optical integrating cavity may comprise a rigid substrate having an interior surface, and a diffusely reflective coating layer formed on the interior surface of the substrate so as to provide the diffusely reflective interior surface of the optical integrating cavity. The coating layer, for example, might take the form of a flat-white paint or white powder coat. A suitable paint might include a zinc-oxide based pigment, consisting essentially of an uncalcined zinc oxide and preferably containing a small amount of a dispersing agent. The pigment is mixed with an alkali metal silicate vehicle-binder, which preferably is a potassium silicate, to form the coating material. For more information regarding exemplary paints, attention is directed to U.S. Pat. No. 6,700,112 by Matthew Brown. Of course, those skilled in the art will recognize that a variety of other diffusely reflective materials may be used. Other diffuse reflective materials are also discussed in some of the above-incorporated applications.

In this example, the cavity 52 forms an integrating type optical cavity. The cavity 52 has a transmissive optical aperture 55, which allows emission of reflected and diffused light from within the interior of the cavity 52 into a region to facilitate a humanly perceptible general lighting application for the fixture 50. Although shown at approximately the center of the plate 54, the opening or transmissive passage forming the optical aperture 55 may be located elsewhere along the plate or at some appropriate region of the dome. In the example, the aperture 55 forms the virtual source of the light from lighting fixture 50. The fixture will have a material bearing the semiconductor nanophosphors. The material may be solid or gaseous as in the earlier examples. The fixture 50 in this example includes a phosphor bearing liquid material 57. Although the liquid may be provided in a number of different ways, in this example, a container 58 of liquid 57 is mounted in the aperture 55.

The lighting fixture 50 also includes at least one source of light energy. The fixture geometry may be used with any appropriate type of solid state light sources, however, as in the earlier examples, the source takes the form of one or more light emitting diodes (L), represented by the two LEDs (L) 56 in the cross-section drawing. Although the LEDs (L) 56 may emit a single type of visible light, a number of colors of visible light or a combination of visible light and at least one light wavelength in another part of the electromagnetic spectrum selected to pump the phosphors, we will assume here that all of the LEDs 56 are rated for emitting electromagnetic energy at a wavelength in the range of 460 nm and below ($\lambda \leqq 460$ nm).

The LEDs (L) 56 may be positioned at a variety of different locations and/or oriented in different directions. Various couplings and various light entry locations may be used. In this and other cavity examples, each LED (L) 56 is coupled to supply light to enter the cavity 52 at a point that directs the light toward a reflective surface so that it reflects one or more times inside the cavity 52, and at least one such reflection is a diffuse reflection. As a result, the direct emissions from the sources 56 would not directly pass through the optical aperture 55, or in this example, directly impact on the liquid 57 in the container 58 mounted in the aperture 55. In examples where the aperture is open or transparent, the points of emission into the cavity are not directly observable through the aperture 55 from the region illuminated by the fixture output. The LEDs (L) 56 therefore are not perceptible as point light sources of high intensity, from the perspective of an area illuminated by the light fixture 50.

Electromagnetic energy, in the form of near UV light energy and/or UV energy from the one or more LEDs (L) 56 and some phosphor emissions, is diffusely reflected and combined within the cavity 52 to form combined light and form a virtual source of such combined light at the aperture 55. Phosphor emissions back into the cavity 52 and similarly reflected and integrated. Such integration, for example, may combine light from multiple sources or spread light from one small source across the broader area of the aperture 55. The integration tends to form a relatively Lambertian distribution across the virtual source. When the fixture illumination is viewed from the area illuminated by the combined light, the virtual source at aperture 55 appears to have substantially infinite depth of the integrated light. Also, the visible intensity is spread uniformly across the virtual source, as opposed to one or more individual small point sources of higher intensity as would be seen if the one or more LED source elements (L) 56 were directly observable without sufficient diffuse processing before emission through the aperture 55.

Pixelation and color striation are problems with many prior solid state lighting devices. When a non-cavity type LED fixture output is observed, the light output from individual LEDs or the like appear as identifiable/individual point sources or 'pixels.' Even with diffusers or other forms of common mixing, the pixels of the sources are apparent. The observable output of such a prior system exhibits a high maximum-to-minimum intensity ratio. In systems using multiple light color sources, e.g. RGB LEDs, unless observed from a substantial distance from the fixture, the light from the fixture often exhibits striations or separation bands of different colors.

Integrating cavity type systems and light fixtures as disclosed herein, however, do not exhibit such pixilation or striations. Instead, the diffuse optical processing in the chamber converts the point source output(s) of the one or more solid state light emitting elements 56 to a virtual source output of light, at the aperture 55 in the examples using optical cavity processing. The virtual source output is unpixelated and relatively uniform across the apparent output area of the fixture, e.g. across the optical aperture 55 of the cavity 52 and/or across the container 58 in the aperture in this first example (FIG. 15). The optical integration sufficiently mixes the light from the solid state light emitting elements 56 and/or phosphor emissions that the combined light output of the virtual source is at least substantially Lambertian in distribution across the optical output area of the cavity, that is to say across the aperture 55 of the cavity 52. As a result, the light output exhibits a relatively low maximum-to-minimum intensity ratio across the aperture 55. In virtual source examples discussed herein, the virtual source light output exhibits a maximum to minimum ratio of 2 to 1 or less over substantially the entire optical output area. The area of the virtual source is at least one order of magnitude larger than the area of the point source output of the solid state emitter 56. The virtual source examples rely on various implementations of the optical integrating cavity 52 as the mixing element to achieve this level of output uniformity at the virtual source, however, other mixing elements could be used if they are configured to produce a virtual source with such a uniform output (Lambertian and/or relatively low maximum-to-minimum intensity ratio across the fixture's optical output area).

The diffuse optical processing may convert a single small area (point) source of light from a solid state emitter 56 to a broader area virtual source at the aperture. The diffuse optical processing can also combine a number of such point source outputs to form one virtual source. The phosphors in the material 57 encapsulated in the container 58 of the optical processing element are used to shift color with respect to at least some light output of the virtual source.

In accordance with the present teachings, the fixture 50 also includes a liquid material 57 containing quantum dots or other type(s) semiconductor nanophosphors, although as noted earlier the material could be a solid or a gas. In this example, the fixture 50 includes an apparatus for producing visible light in response to electromagnetic energy from a solid state source, in the form of a container 58 encapsulating the liquid 57; and the container 58 is located in the aperture 55. In a manner similar to the examples of FIGS. 1 and 14, the liquid 57 is a transmissive material. The material is of a type and the nanophosphor(s) are dispersed therein in such a manner that the material bearing the semiconductor nanophosphor(s) appears at least substantially color-neutral to the human observer, when the solid state lighting device is off. The material may be clear or translucent, although optical properties of the material, such as absorption and/or scattering, are independent of wavelength at least over much of the visible light spectrum.

The liquid material 57 in the lighting fixture 50 includes semiconductor nanophosphors sized and possibly doped to provide a color shift that is desirable, for the general lighting application of the fixture 50. For example, if one or more of the LEDs (L) 56 emit UV or near UV light, the nanophosphors of appropriate materials, sizes and/or doping could shift that light to one or more desirable wavelengths in the visible portion of the spectrum to produce spectral results as in one of the examples of FIGS. 5-13. In such a case, the light output would be a high CRI white light of one of the color temperatures listed in Table 1 above and would provide high spectral content/quality as in the earlier examples.

The aperture 55 (and/or passage through liquid 57 and container 58) may serve as the light output if the fixture 50, directing integrated light of relatively uniform intensity distribution to a desired area or region to be illuminated in accordance with the general lighting application. It is also contemplated that the fixture 50 may include one or more additional processing elements coupled to the aperture, such as a colliminator, a grate, lens or diffuser (e.g. a holographic element). In the first example, the fixture 50 includes a further optical processing element in the form of a deflector or concentrator 59 coupled to the aperture 55, to distribute and/or limit the light output to a desired field of illumination.

The deflector or concentrator 59 has a reflective inner surface 59*s*, to efficiently direct most of the light emerging from the cavity and the liquid into a relatively narrow field of view. A small opening at a proximal end of the deflector 59 is coupled to the aperture 55 of the optical integrating cavity 52. The deflector 59 has a larger opening at a distal end thereof. Although other longitudinal cross-sectional shapes may be used, such as various curved reflector shapes (e.g. parabolic or elliptical), the deflector 59 in this example is conical, essentially in the shape of a truncated cone (straight-sided when shown in cross-section). The angle and/or curvature of the cone wall(s) and the size of the distal opening of the conical deflector 59 define an angular field of light energy emission from the device 50. Although not shown, the large opening of the deflector may be covered with a transparent plate or lens, or covered with a grating, to prevent entry of dirt or debris through the cone into the fixture 50 and/or to further process the output light energy.

The conical deflector 59 may have a variety of different shapes, depending on the particular lighting application. In the example, where cavity 52 is hemispherical, the lateral cross-section of the conical deflector 59 (horizontal across the drawing in the illustrated orientation) would typically be circular. However, the deflector 59 may be somewhat oval in lateral shape. Although the aperture 55 may be round, the distal opening may have other shapes (e.g. oval, rectangular or square); in which case, more curved deflector walls provide a transition from round at the aperture coupling to the alternate shape at the distal opening. In applications using a semi-cylindrical cavity, the deflector may be elongated or even rectangular in cross-section. The shape of the aperture 55 also may vary, but will typically match the shape of the small end opening of the deflector 59. Hence, in the example, the aperture 55 would be circular as would the matching proximal opening at the small end of the conical deflector 59. However, for a device with a semi-cylindrical cavity and a deflector with a rectangular cross-section, the aperture and associated deflector opening may be rectangular with square or rounded corners.

The deflector 59 comprises a reflective interior surface 59*s* between the distal end and the proximal end. In some examples, at least a substantial portion of the reflective interior surface 59*s* of the conical deflector 59 exhibits specular reflectivity with respect to the integrated radiant energy. As discussed in U.S. Pat. No. 6,007,225, for some applications, it may be desirable to construct the deflector 59 so that at least some portion(s) of the inner surface 59*s* exhibit diffuse reflectivity or exhibit a different degree of specular reflectivity (e.g., quasi-secular), so as to tailor the performance of the deflector 59 to the particular general lighting application. For other applications, it may also be desirable for the entire interior surface 59*s* of the deflector 59 to have a diffuse reflective characteristic. In such cases, the deflector 59 may be constructed using materials similar to those taught above for construction of the optical integrating cavity 52. In addition to reflectivity, the deflector may be implemented in different colors (e.g. silver, gold, red, etc.) along all or part of the reflective interior surface 59*s*.

In the illustrated example, the large distal opening of the deflector 59 is roughly the same size as the cavity 52. In some applications, this size relationship may be convenient for construction purposes. However, a direct relationship in size of the distal end of the deflector and the cavity is not required. The large end of the deflector may be larger or smaller than the cavity structure. As a practical matter, the size of the cavity is optimized to provide effective integration or combination of light from the desired number of LED type solid state sources 56. The size, angle and shape of the deflector 59 determine the area that will be illuminated by the combined or integrated light emitted from the cavity 52 via the aperture 55 and the phosphor bearing liquid 57.

For convenience, the illustration shows the lighting device 50 emitting the light downward from the virtual source, that is to say downward through the aperture 55 and the liquid 57. However, the lighting device 50 may be oriented in any desired direction to perform a desired general lighting application function. Also, the optical integrating cavity 52 may have more than one optical aperture or passage, for example, oriented to allow emission of integrated light in two or more different directions or regions. The additional optical passage may be an opening or may be a partially transmissive or translucent region of a wall of the cavity.

A system incorporating the light fixture 50 may also include a controller, like the controller 33 in the example of FIG. 1.

Figure 16:
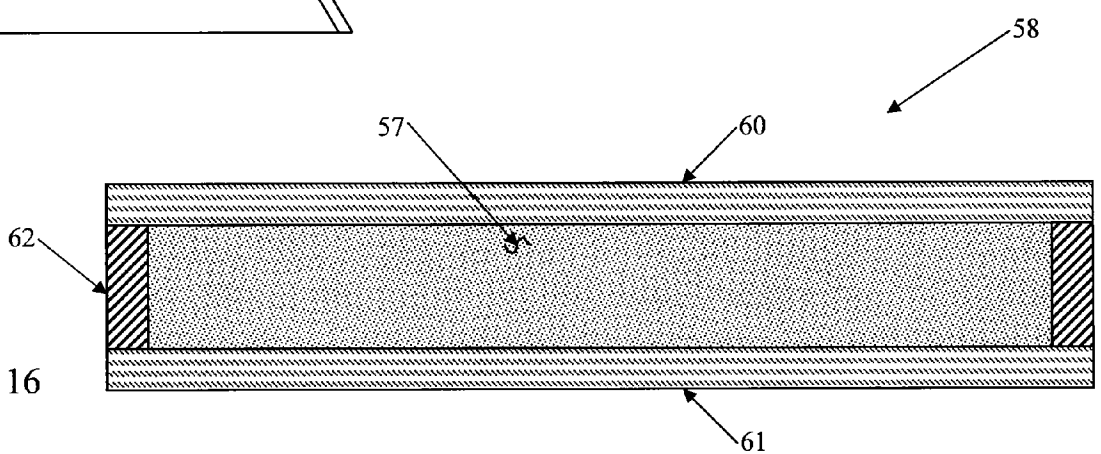
FIG. 16 is an enlarged cross-sectional view of the liquid filled container used in the light fixture of FIG. 15.

Those skilled in the art will recognize that the container 58 for the phosphor bearing liquid 57 may be constructed in a variety of ways. FIG. 16 is a cross-sectional view of one example. As noted above, for simplicity, we have assumed that the aperture 55 in the embodiment of FIG. 15 is circular. Hence, the container 8 would also be circular and sized to fit in the aperture 55. As shown in cross-section in FIG. 16, the container 58 includes two light transmissive elements 60 and 61, which may be transparent or translucent. The element 60 would be the portion of the structure that receives the electromagnetic energy from the LEDs 56 forming the source or sources, in this example, and that portion would most likely be transparent. The element 61 would be the portion through which phosphor emissions would be emitted out of the device, even if emitted back into the cavity 52 for further reflection and passage out through the optical processing element 58. The element 61 would be transmissive with respect to at least visible light, although it may be transparent or translucent.

The elements 60 and 61, for example, may be formed of a suitable glass or acrylic material. The elements 60 and 61 may be glued to or otherwise attached to a sealing ring 12. When so attached, the sealing ring provides an air tight and liquid tight seal for the volume between the elements 60 and 61. The liquid 57 substantially fills the volume of the container formed by the elements 60 and 61 and the sealing ring 62, with little or no air entrained in the liquid 67. A specific gas bubble or a vacuum vapor bubble may be present, as discussed with regard to an earlier example. For example, if under low pressure, some of the liquid may transition to the gaseous state within the interior of the container, for example, if the cavity is filled with the liquid in a heated state and the liquid cools after the filled container is sealed. However, this bubble would shrink or disappear as the liquid reaches operating temperature when the fixture is on.

The height of the container 58 (vertical in the illustrated orientation of FIGS. 15 and 16) may be selected to provide an adequate volume for a desired amount of the liquid 57. The height of the container may be less than, equal to or greater than the height of the opening through the board 54 that forms the aperture 55.

The phosphors dispersed in the liquid 57 will be selected to facilitate a particular lighting application for the fixture 50. That is to say, for a given emission spectrum of light produced by the LEDs (L) 56, the material, sizing and/or doping of the semiconductor nanophosphors will be such as to shift at least some of the light emerging through the aperture 55 in a desired manner to produce a white light output of a nominal color temperature and meeting the spectral performance metrics with respect to the 210 nm section of the appropriate black body radiation spectrum as in the earlier examples.

In the example of FIGS. 15 and 16, some light entering the container 58 through the upper element 60 may pass through the liquid 67 without interacting with any of the phosphors. Other light from the cavity 52 will interact with the phosphors. As in the earlier examples, the material 57 may have sufficient concentration of the phosphors to absorb substantially all of the excitation or pumping energy provided by the sources 56. Light that interacts with the semiconductor nanophosphors will be absorbed by the phosphors and re-emitted by the phosphors at the different wavelengths of the characteristic emission spectra (see FIG. 4). Some of the light emitted from the phosphors in the liquid 57 will be emitted back through the element 60 into the cavity 52, for diffuse reflection and integration with light from the LEDs (L) 56, for later emission through the aperture 55, the liquid 57 and the elements 60 and 61 of the container 58. Other light emitted from the phosphors in the liquid 57 will be emitted through the element 61, that is to say together with any light that may pass through the liquid 57 without interacting with any of the phosphors. In this way, light emerging from the fixture 50 via the aperture 55, the container 58 and the liquid material 57 bearing the nanophosphors may include some relatively small amount of integrated light of the sources, from within the cavity 52 as well some light shifted by interaction (absorption and re-emission) via the phosphors contained in the liquid 57 both directly emitted through element 61 and after integration in cavity 52 and subsequent passage through the container 58. This combination of light provides the desired spectral characteristic of the fixture output, that is to say, for the intended general lighting application, as in the earlier examples.

In the example of FIGS. 15 and 16, the container 58 took the form of a flat disk. However, the container may have a variety of other shapes. Further integrating cavity examples are discussed in several of the above-incorporated applications. Different shapes and/or textures may be chosen to facilitate a particular output distribution pattern and/or efficient extraction of integrated light from the cavity.

The cavity examples discussed so far, relative to FIGS. 15 and 16, have utilized a container for the liquid that effectively positions the liquid in the optical aperture to form a light transmissive passage for integrated light emerging as a uniform virtual source from the integrating cavity. Those skilled in the art will recognize that the liquid may be provided in the fixture in a variety of other ways and/or at other locations. In particular, it may be desirable to substantially fill the volume of the optical integrating cavity with the nanophosphor bearing material. It may be helpful to consider an example of a liquid filled cavity arrangement.

Figure 17:
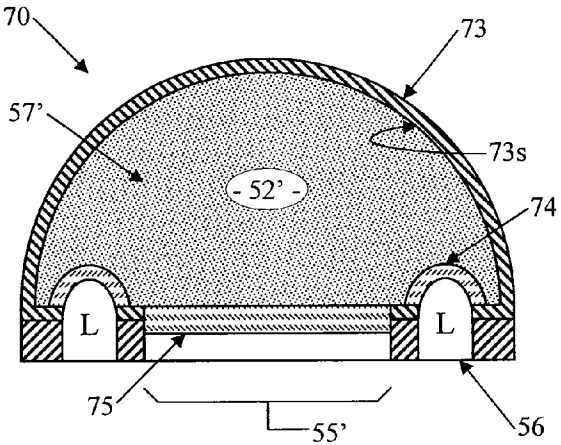
FIG. 17 is a cross-section of another light fixture for a general lighting application, in which an optical integrating cavity is sealed to form the container for the liquid or gas containing the phosphors.

FIG. 17 therefore shows a fixture 70 in which the liquid 57' substantially fills the optical integrating cavity 52'. As in the example of FIG. 15, the lighting fixture 70 has solid state light sources, again exemplified by a number of LEDs (L) 56. The fixture 70 also includes an optical integrating cavity 52 that itself contains the liquid 57' bearing the dispersed semiconductor nanophosphors of the types discussed above.

In this example, the cavity 52' is formed by a material having a diffusely reflective interior surface or surfaces, in the shape of an integral member 73 forming both the dome and the plate. The material of the member 53 is chosen to provide a sealed liquid container, but the interior surface or surfaces of the member use materials similar to those described above in the discussion of FIG. 15 to provide the desired diffuse reflectivity on some or all of the internal surface(s) 73*s* with respect to light in the cavity 52'. Again, although a variety of shapes may be used, we will assume that the cavity 52' takes the shape of a hemisphere, for ease of illustration and discussion.

Openings through the member 53 are sealed in an air tight and liquid tight manner. For example, openings for the LEDs (L) 56 may be sealed by covering the LEDs with an optical adhesive or similar light transmissive sealant material as shown at 74, which protects the LEDs from the liquid 57' and seals the spaces between the LEDs and the surrounding structure of the member 73. The light transmissive sealant material 74 is the portion of the container formed by the optical integrating cavity through which the apparatus containing the liquid with the nanophosphors receives electromagnetic energy from the LEDs 56, and typically the sealant material 74 would be transparent.

The member 73 in this example also has an aperture 55' through which integrated light emerges from the cavity 52'. One or more additional optical processing elements may be coupled to the aperture, such as the deflector discussed above relative to the example of FIG. 15. However, in this example, the aperture 55' provides the uniform virtual source and the output of the light fixture 70. To contain the liquid 57, this aperture 55' is sealed with a light transmissive plug 75, for example, formed of a suitable plastic or glass. The plug may be pressed into the aperture, but typically, a glue or other sealant is used around the edges of the plug 75 to prevent air or liquid leakage. The light transmissive plug 75 is the portion of the container formed by the optical integrating cavity through which the apparatus containing the liquid with the nanophosphors emits light generated by excitation of the nanophosphors. The light transmissive plug 75 in the aperture 55' may be transparent, or it may be translucent so as to provide additional light diffusion. As in the earlier examples, the liquid is of a type and the nanophosphor(s) are dispersed therein in such a manner that the material bearing the semiconductor nanophosphor(s) appears at least substantially color-neutral to the human observer, when the solid state lighting device is off.

Again, each LED (L) 56 is coupled to supply light to enter the cavity 52' at a point that directs the light toward a reflective surface 73' so that it reflects one or more times inside the cavity 52', and at least one such reflection is a diffuse reflection. As the light from the LEDs (L) 56 passes one or more times through the volume of the cavity 52', the light also passes one or more times through the liquid 57'. As in the earlier example, the liquid contains a mixture of the nanophosphors. Some or all of the light interacts with the phosphors to produce a shift, and some of the shifted light reflects off the reflective surface(s) 73 of the cavity 52'. The cavity 52' acts as an optical integrating cavity to produce optically integrated light of a uniform character forming a uniform virtual source at the aperture 55'. The integrated light output may include some light from the sources 56, although the amount of any of such light may be relatively small. However, the integrated light output includes substantial amounts of the light shifted by the phosphors of the liquid 57'. The output exhibits similar uniform virtual source characteristics to the light at the aperture in the example of FIG. 15; but in the example of FIG. 17, the integration of the shifted light is completed within the cavity 52' before passage through the optical aperture 55. The mixture of phosphors is such that the device output via the aperture exhibits the spectral characteristics for one of the nominal color temperatures as in the earlier examples.

As noted earlier, we assumed that the total concentration of phosphors in the mixture are sufficient as to fully absorb all of the emission of electromagnetic energy from the solid state source. In examples like that of FIG. 17, the phosphor bearing material is in relatively close proximity to the various sources. Such close proximity together with high degree of absorption of the energy from the source(s), however, may subject the phosphors to sufficient heat to result in degradation of performance, at least until the phosphors can be cooled (e.g. by a period while the system is OFF). Cooling during operation, for example, by circulation of the liquid or gas bearing the phosphors within the container, may help to dissipate this heat and maintain performance during ongoing light generation from the device. Another solution might be to provide some separation between the LEDs or other devices serving as the source and the container for the material bearing the phosphors (compare FIG. 17, to FIGS. 1, 14 and 15).

In the examples of FIGS. 1 and 14-17, the apparatus for producing visible light in response to electromagnetic energy from a solid state source took the form of an optical processing element configured for incorporation in a solid state light fixture. However, the present teachings encompass use of the technology in other types of solid state lighting devices, such as a tubular or bulb type lamp product. To appreciate such a use, it may be helpful to consider an example of a lamp.

Figure 18:
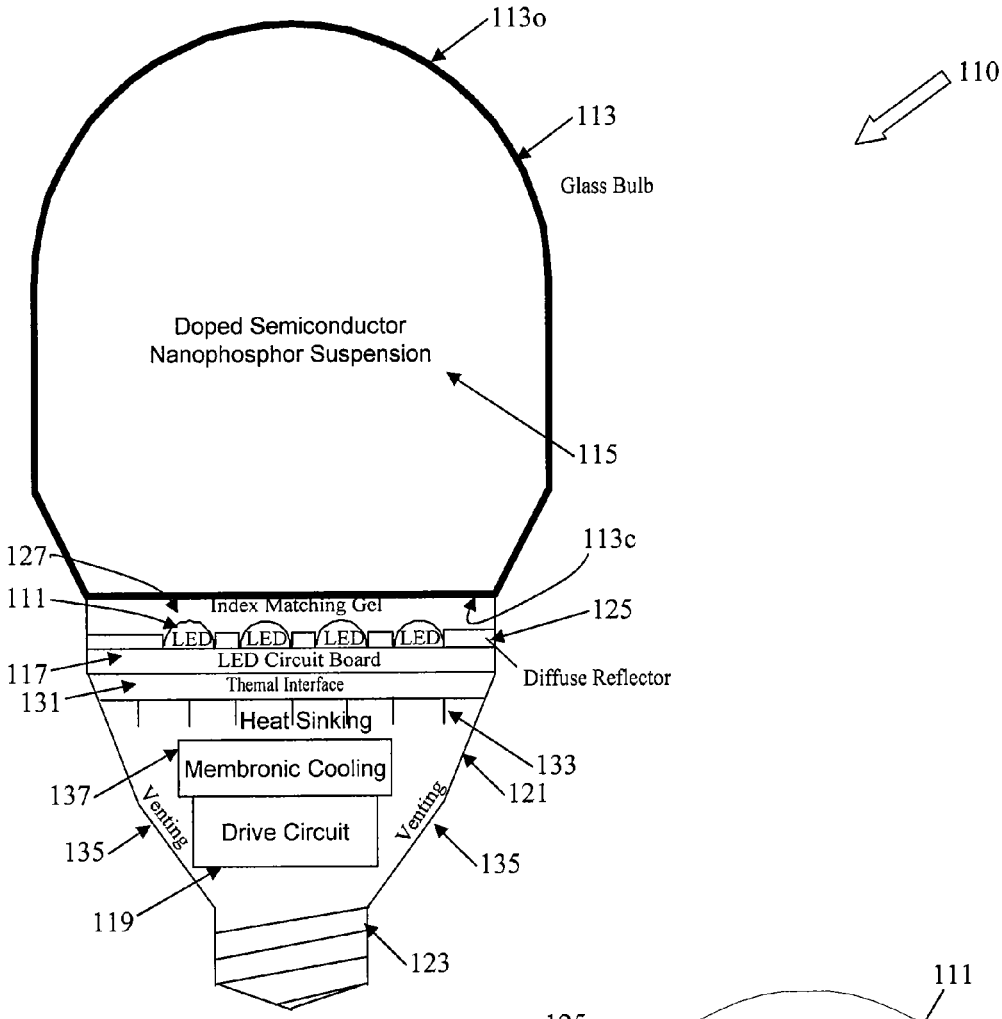
FIG. 18 is a cross-sectional view of an example of a solid state lamp, for lighting applications, which uses a solid state source and phosphors pumped by energy from the source to produce visible light of the characteristics discussed herein.

FIG. 18 illustrates an example of a solid state lamp 110, in cross section. The exemplary lamp 110 may be utilized in a variety of lighting applications. The lamp, for example includes a solid state source for producing electromagnetic energy. The solid state source is a semiconductor based structure for emitting electromagnetic energy of one or more wavelengths within the range to excite the nanophosphors used in the particular lamp. In the example, the source comprises one or more light emitting diode (LED) devices, although other semiconductor devices might be used. Hence, in the example of FIG. 18, the source takes the form of a number of LEDs 111.

It is contemplated that the LEDs 111 could be of any type rated to emit energy of wavelengths from the blue/green region around 460 nm down into the UV range below 380 nm. Although other phosphors could be used, we will assume that the lamp 110 uses a combination of three doped semiconductor nanophosphors and a non-doped semiconductor nanophosphor like those discussed above relative to FIGS. 4-13. As discussed earlier, the exemplary nanophosphors have absorption spectra having upper limits around 460 nm or below. In the specific examples, including some for white light lamp applications, the LEDs 111 are near UV LEDs rated for emission somewhere in the 380-420 nm range, although UV LEDs could be used alone or in combination with near UV LEDs even with the exemplary nanophosphors. A specific example of a near UV LED, used in several of the specific white lamp examples, is rated for 405 nm emission.

The nanophosphors in the lamp 110 convert energy from the source into visible light of one or more wavelengths to produce a desired characteristic of the visible light output of the lamp. The semiconductor nanophosphors are remotely deployed, in that they are outside of the individual device packages or housings of the LEDs 111. For this purpose, the exemplary lamp includes an apparatus in the form of a container formed of optically transmissive material coupled to receive and process electromagnetic energy from the LEDs 111 forming the solid state source. The container contains a material, which at least substantially fills the interior volume of the container. For example, if a liquid is used, there may be some gas in the container as well, although the gas should not include oxygen as oxygen tends to degrade the nanophosphors.

The material may be a solid, although liquid or gaseous materials may help to improve the florescent emissions by the nanophosphors in the material, as discussed earlier. Hence, although the material in the container may be a solid, further discussion of the examples will assume use of a liquid or gaseous material. The lamp 110 in the example includes a bulb 113. Although other materials could be used, the discussion below assumes that the bulb is glass. In some examples, there could be a separate container, in which case the bulb encloses the container. In the illustrated example, however, the glass of the bulb 113 serves as the container. The container wall(s) are transmissive with respect to at least a substantial portion of the visible light spectrum. For example, the glass of the bulb 113 will be thick enough (as represented by the wider lines), to provide ample strength to contain a liquid or gas material if used to bear the semiconductor nanophosphors in suspension, as shown at 115. However, the material of the bulb will allow transmissive entry of energy from the LEDs 111 to reach the nanophosphors in the material 115 and will allow transmissive output of visible light principally from the excited nanophosphors.

The glass bulb/container 113 receives energy from the LEDs 111 through a surface of the bulb, referred to here as an optical input coupling surface 113*c*. The example shows the surface 113*c* for the receiving portion of the container structure as a flat surface, although obviously outer contours may be used. Light output from the lamp 110 emerges through one or more other surfaces of the bulb 113, forming the output portion of the container structure, and here referred to as output surface 113*o*. As noted, in this example, the bulb 113 here is glass, although other appropriate transmissive materials may be used. For a diffuse outward appearance of the bulb, the output surface(s) 113*o* may be frosted white or translucent, although the optical input coupling surface 113*c* might still be transparent to reduce reflection of energy from the LEDs 111 back towards the LEDs. Alternatively, the output surface 113*o* may be transparent.

For further discussion, we will assume that the container formed by the glass bulb 113 is at least substantially filled with a color-neutral transmissive (e.g. translucent or clear/transparent) liquid or gaseous material 115 bearing a number of different semiconductor nanophosphors dispersed in the liquid or gaseous material 115, e.g. in one of the mixtures listed in Table 4 and discussed above relative to FIGS. 4-13. Also, for further discussion, we will assume that the LEDs 111 are near UV emitting LEDs, such as 405 nm LEDs or other types of LEDs rated to emit somewhere in the wavelength range of 380-420 nm. Each of the semiconductor nanophosphors is of a type excited in response to near UV electromagnetic energy from the LEDs 111 of the solid state source. When so excited, each doped semiconductor nanophosphor re-emits visible light of a different spectrum (see FIG. 4). When excited by the electromagnetic energy received from the LEDs 111, the semiconductor nanophosphors together produce visible light output for the lamp 110 through the exterior surface(s) of the glass bulb 113. As in the earlier examples, the liquid or gaseous material 115 with the semiconductor nanophosphors dispersed therein appears at least substantially color-neutral when the lamp 110 is off, that is to say it has little or no perceptible tint. When the lamp is on, however, the output light exhibits a color temperature in a range for one of the nominal color temperatures as well as the spectral characteristics for that nominal light, as in the earlier fixture examples For lamp applications, it may be commercially desirable for a bulb to have a white outward appearance. If the bulb 113 is white along visible surfaces like output surface 113*o*, then the material 115 could be transparent or clear, although a translucent material could be used. If the bulb 113 is clear, then the material 115 could be translucent so that the product would appear white in the off-state. A clear bulb 113 and a clear material 115 could be used together, but in the off-state, a person could see the LEDs 111 from at least some directions.

The LEDs 111 are mounted on a circuit board 117. The exemplary lamp 110 also includes circuitry 119. Although drive from DC sources is contemplated for use in existing DC lighting systems, the examples discussed in detail utilize circuitry configured for driving the LEDs 111 in response to alternating current electricity, such as from the typical AC main lines. The circuitry may be on the same board 117 as the LEDs or disposed separately within the lamp 110 and electrically connected to the LEDs 111. Electrical connections of the circuitry 119 to the LEDs and the lamp base are omitted here for simplicity.

A housing 121 at least encloses the circuitry 119. In the example, the housing 121 together with a lamp base 123 and a face of the glass bulb 113 also enclose the LEDs 111. The lamp 110 has a lighting industry standard lamp base 123 mechanically connected to the housing and electrically connected to provide alternating current electricity to the circuitry 119 for driving the LEDs 111.

The lamp base 123 may be any common standard type of lamp base, to permit use of the lamp 110 in a particular type of lamp socket. Common examples include an Edison base, a mogul base, a candelabra base and a bi-pin base. The lamp base may have electrical connections for a single intensity setting or additional contacts in support of three-way intensity setting/dimming.

Figure 19:
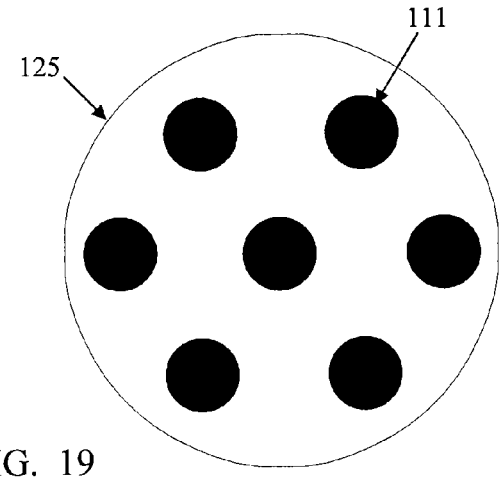
FIG. 19 is a plan view of the LEDs and reflector of the lamp of FIG. 18.

The exemplary lamp 110 of FIG. 18 may include one or more features intended to prompt optical efficiency. Hence, as illustrated, the lamp 110 includes a diffuse reflector 125. The circuit board 117 has a surface on which the LEDs 111 are mounted, so as to face toward the light receiving surface 113*c* of the glass bulb 113 containing the nanophosphor bearing material 115. The reflector 125 covers parts of that surface of the circuit board 117 in one or more regions between the LEDs 111. FIG. 19 is a view of the LEDs 111 and the reflector 125. When excited, the nanophosphors in the material 115 emit light in many different directions, and at least some of that light would be directed back toward the LEDs 111 and the circuit board 117. The diffuse reflector 125 helps to redirect much of that light back through the glass bulb 113 for inclusion in the output light distribution.

The lamp 110 may use one or any number of LEDs 111 sufficient to provide the necessary pumping of the phosphors to produce a desired device output intensity. The example of FIG. 19 shows seven LEDs 111, although the lamp 110 may have more or less LEDs than in that example.

There may be some air gap between the emitter outputs of the LEDs 111 and the facing optical coupling surface 113*c* of the glass bulb container 113 (FIG. 18). However, to improve out-coupling of the energy from the LEDs 111 into the light transmissive glass of the bulb 113, it may be helpful to provide an optical grease, glue or gel 127 between the surface 113*c* of the glass bulb 113 and the optical outputs of the LEDs 111. This index matching material 127 eliminates any air gap and provides refractive index matching relative to the material of the glass bulb container 113.

The examples also encompass technologies to provide good heat conductivity so as to facilitate dissipation of heat generated during operation of the LEDs 111. Hence, the exemplary lamp 110 includes one or more elements forming a heat dissipater within the housing for receiving and dissipating heat produced by the LEDs 111. Active dissipation, passive dissipation or a combination thereof may be used. The lamp 110 of FIG. 18, for example, includes a thermal interface layer 131 abutting a surface of the circuit board 117, which conducts heat from the LEDs and the board to a heat sink arrangement 133 shown by way of example as a number of fins within the housing 121. The housing 121 also has one or more openings or air vents 135, for allowing passage of air through the housing 121, to dissipate heat from the fins of the heat sink 133.

The thermal interface layer 131, the heat sink 133 and the vents 135 are passive elements in that they do not consume additional power as part of their respective heat dissipation functions. However, the lamp 110 may include an active heat dissipation element that draws power to cool or otherwise dissipate heat generated by operations of the LEDs 111. Examples of active cooling elements include fans, Peltier devices or the like. The lamp 110 of FIG. 18 utilizes one or more membronic cooling elements. A membronic cooling element comprises a membrane that vibrates in response to electrical power to produce an airflow. An example of a membronic cooling element is a SynJet® sold by Nuventix. In the example of FIG. 18, the membronic cooling element 137 operates like a fan or air jet for circulating air across the heat sink 133 and through the air vents 135.

In the orientation illustrated in FIG. 18, white light from the semiconductor nanophosphor excitation is dispersed upwards and laterally, for example, for omni-directional lighting of a room from a table or floor lamp. The orientation shown, however, is purely illustrative. The lamp 110 may be oriented in any other direction appropriate for the desired lighting application, including downward, any sideways direction, various intermediate angles, etc.

In the example of FIG. 18, the glass bulb 113, containing the material 115 with the semiconductor nanophosphors produces a wide dispersion of output light, which is relatively omni-directional (except directly downward in the illustrated orientation). Such a light output intensity distribution corresponds to that currently offered by A-lamps. Other bulb/container structures, however, may be used; and a few examples include a globe-and-stem arrangement for A-Lamp type omni-directional lighting, as well as R-lamp and Par-lamp style bulbs for different directed lighting applications. At least for some of the directed lighting implementations, some internal surfaces of the bulbs may be reflective, to promote the desired output distributions. Tubular lamp implementations are also contemplated.

The lamp 110 of FIG. 18 has one of several industry standard lamp bases 123, shown in the illustration as a type of screw-in base. The glass bulb 113 exhibits a form factor within standard size, and the output distribution of light emitted via the bulb 113 conforms to industry accepted specifications, for a particular type of lamp product. Those skilled in the art will appreciate that these aspects of the lamp 110 facilitate use of the lamp as a replacement for existing lamps, such as incandescent lamps and compact fluorescent lamps. Tubular implementations might be used as replacements for fluorescent tubes.

The housing 121, the base 123 and components contained in the housing 121 can be combined with a bulb/container in one of a variety of different shapes. As such, these elements together may be described as a 'light engine' portion of the lamp for generating the near UV energy. Theoretically, the engine and bulb could be modular in design to allow a user to interchange glass bulbs, but in practice the lamp is an integral product. The light engine may be standardized across several different lamp product lines where the mixture of phosphors contained in the bulb varies to provide different CCT and associated spectral characteristics and/or where the bulb varies in shape. In the example of FIG. 1, housing 121, the base 123 and components contained in the housing 121 could be the same for A-lamps, R-lamps, Par-lamps or other styles of lamps. A different base can be substituted for the screw base 123 shown in FIG. 18, to produce a lamp product configured for a different socket design.

As outlined above, the lamp 110 will include or have associated therewith remote semiconductor nanophosphors in a container that is external to the LEDs 111 of the solid state source. As such, the phosphors are located apart from the semiconductor chips of the LEDs 111 used in the particular lamp 110, that is to say remotely deployed.

The semiconductor nanophosphors are dispersed, e.g. in suspension, in a liquid or gaseous material 115, within a container (bulb 113 in the lamp 110 of FIG. 18). The liquid or gaseous medium preferably exhibits high transmissivity and/or low absorption to light of the relevant wavelengths and is color-neutral when the LEDs 111 are off, although for example it may be transparent or translucent.

In an example of a white light type lamp, the semiconductor nanophosphors in the material shown at 115 are of types or configurations (e.g. selected types of semiconductor nanophosphors) excitable by the near UV energy from LEDs 111 forming the solid state source. Together, the excited nanophosphors produce output light that is at least substantially white and has a color rendering index (CRI) of 85 or higher. The lamp output light produced by this near UV excitation of the semiconductor nanophosphors exhibits color temperature in one of several desired ranges along the black body curve. Different light lamps 110 designed for different color temperatures of white output light would use different formulations of mixtures of doped semiconductor nanophosphors. The white output light of the lamp 110 exhibits color temperature in one of specific ranges and exhibits high quality spectral characteristics for a nominal value of color temperature, as in the fixture examples.

The lamps under consideration here may utilize a variety of different structural arrangements. In the example of FIG. 18, the glass bulb 113 also served as the container for the material 115 bearing the doped semiconductor nanophosphors. For some applications and/or manufacturing techniques, it may be desirable to utilize a separate container for the semiconductor nanophosphors and enclose the container within a bulb (glass or the like) that provides a particular form factor and outward light bulb appearance and light distribution.

The phosphor-centric solid state lighting technology discussed herein, using a material bearing one or more phosphors dispersed therein, may be adapted to a variety of different lamp structures, only one example of which is shown in FIGS. 18 and 19. Several additional lamp examples are discussed in some detail in pending U.S. patent application Ser. Nos. 12/697,596 titled "LAMP USING SOLID STATE SOURCE AND DOPED NANOPHOSPHOR" and 12/729,788 titled "SOLID STATE TUBULAR LAMP USING DOPED NANOPHOSPHORS FOR PRODUCING HIGH-CM WHITE LIGHT FOR FLORESCENCE REPLACEMENT OR THE LIKE," the disclosures of both of which are incorporated entirely herein by reference.

The solid state sources in the various exemplary fixtures and lamps may be driven/controlled by a variety of different types of circuits. Depending on the type of LEDs selected for use in a particular lamp product design, the LEDs may be driven by AC current, typically rectified; or the LEDs may be driven by a DC current after rectification and regulation. The degree of control may be relatively simple, e.g. ON/OFF in response to a switch, or the circuitry may utilize a programmable digital controller, to offer a range of sophisticated options. Intermediate levels of sophistication of the circuitry and attendant control are also possible. Detailed examples of just a few different circuits that may be used to drive the LED type solid state sources in the fixture and lamp examples above are described in more detail in the two above-incorporated earlier lamp related applications and publications.

The description and drawings have covered a number of examples of devices or systems that utilize an element that contains the phosphor bearing material. Those skilled in the art will recognize the lighting devices or systems may use two or more elements or containers for phosphor bearing material, wherein the phosphors are the same or different in the different containers.

The drawings and the discussion above have specifically addressed only a small number of examples of light emitting devices and solid state lighting devices that may utilize the phosphor-centric technique to produce high spectral quality white light. Those skilled in the art will appreciate that the technology is readily adaptable to a wide range of other light emitting devices, lighting devices, systems and/or device components. By way of just a few more examples, attention may be directed to other fixture and lamp configurations disclosed in the above-incorporated earlier applications and publications.

Also, the discussion developed a rationale for adopting a 210 nm range of the visible spectrum over which the device output should exhibit a radiation spectrum that approximates a black body radiation spectrum for the rated color temperature for the device, over at least a predetermined portion of the visible light portion of the black body radiation spectrum for the rated color temperature. The graphs show, however, that over subsets within that range, the output spectrum may approximate the black body radiation spectrum even more closely, for example, over a band of 200 nm, a band of 190 nm or a band of 180 nm.

As noted earlier, the present phosphor-centric approach to providing high quality/content spectral light output is applicable to a variety of different types of light emitting devices. The illustrated examples and much of the discussion has focused on lighting devices, such as fixtures or lamps. However, the present teachings also are applicable to the solid state source itself, for example, by incorporation of the phosphors within the device 11 of FIG. 2. Using FIG. 2 as an example, one or more elements in the package, such as the reflector 17 or dome 23 may be doped or coated with the exemplary phosphor materials, to provide a semiconductor device level implementation of the phosphor centric approach to high quality spectral content white lighting. Additional examples of structures of semiconductor devices and/or packages thereof that may incorporate phosphors, which could be adapted to incorporate the combinations of phosphors to produce high quality spectral content white light as disclosed herein, are discussed in some detail in pending U.S. patent application Ser. No. 12/629,599 titled "SOLID STATE LIGHT EMITTER WITH NEAR-UV PUMPED NANOPHOSPHORS FOR PRODUCING HIGH CRI WHITE LIGHT," the disclosure of which is incorporated entirely herein by reference.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A lighting device for a lighting application, comprising:

a solid state source, containing at least one semiconductor chip within at least one package, for producing electromagnetic energy of a first emission spectrum;

an optical element outside the at least one package of the solid state source and separate from the at least one semiconductor chip, arranged to receive electromagnetic energy of the first emission spectrum from the solid state source; and at least three remote phosphors associated with the optical element and apart from the at least one semiconductor chip, each of the remote phosphors being of a type excited in response to electromagnetic energy of the first emission spectrum from the solid state source for re-emitting visible light of a different one of a plurality of second emission spectra, wherein:

(a) a visible light output of the lighting device for the lighting application contains a combination of light of all of the second emission spectra from the phosphors, when the remote phosphors together are excited by electromagnetic energy of the first emission spectrum from the solid state source;

(b) the visible light output of the lighting device produced when the remote phosphors are excited is at least substantially white and exhibits a color temperature corresponding to a rated color temperature for the lighting device; and (c) the visible light output of the lighting device produced when the remote phosphors are excited exhibits a radiation spectrum approximating a black body radiation spectrum for the rated color temperature for the device, over at least a predetermined portion of the visible light portion of the black body radiation spectrum for the rated color temperature.

2. The light emitting device of claim 1, wherein at least two of the remote phosphors are semiconductor nanophosphors.

3. The light emitting device of claim 2, wherein at least one of semiconductor nanophosphors is a doped semiconductor nanophosphor.

4. The light emitting device of claim 1, wherein the at least three remote phosphors comprise four remote phosphors.

5. The light emitting device of claim 3, wherein at least three of the remote phosphors are doped semiconductor nanophosphors.

6. The light emitting device of claim 1, wherein the visible light output of the light emitting device produced when the remote phosphors are excited:

(i) deviates no more than ±50% from a black body radiation spectrum for the rated color temperature for the device, over at least 210 nm of the visible light spectrum; and (ii) has an average absolute value of deviation of no more than 15% from the black body radiation spectrum for the rated color temperature for the device, over at least the 210 nm of the visible light spectrum.

7. The light emitting device of claim 1, wherein the visible light output of the lighting device produced when the remote phosphors are excited has a CRI of at least 85.

8. The light emitting device of claim 6, wherein the visible light output of the light emitting device produced when the remote phosphors are excited:

(i) deviates no more than ±42% from the black body radiation spectrum for the rated color temperature for the device, over at least 210 nm of the visible light spectrum; and (ii) has an average absolute value of deviation of no more than 12% from the black body radiation spectrum for the rated color temperature for the device, over at least the 210 nm of the visible light spectrum.

9. The light emitting device of claim 6, wherein the visible light output of the light emitting device produced when the remote phosphors are excited:

(i) deviates no more than ±37% from a black body radiation spectrum for the rated color temperature for the device, over at least 210 nm of the visible light spectrum; and (ii) has an average absolute value of deviation of no more than 11% from the black body radiation spectrum for the rated color temperature for the device, over at least the 210 nm of the visible light spectrum.

10. The light emitting device of claim 9, wherein the visible light output of the lighting device produced when the remote phosphors are excited has a CRI of at least 90.

11. The light emitting device of claim 6, wherein the visible light output of the light emitting device produced when the remote phosphors are excited:

(i) deviates no more than ±37% from a black body radiation spectrum for the rated color temperature for the device, over at least 210 nm of the visible spectrum; and (ii) has an average absolute value of deviation of no more than 8% from the black body radiation spectrum for the rated color temperature for the device, over at least the 210 nm of the visible spectrum.

12. The light emitting device of claim 1, wherein the rated color temperature is one of the following color temperatures:

2,700° Kelvin;
3,000° Kelvin;
3,500° Kelvin;
4,000° Kelvin;
4,500° Kelvin;
5,000° Kelvin;
5,700° Kelvin; and
6,500° Kelvin.

13. The light emitting device of claim 12, wherein the visible light output from the device produced by the excitation of the phosphors has a color temperature in one of the following ranges:

2,725±145° Kelvin;
3,045±175° Kelvin;
3,465±245° Kelvin;
3,985±275° Kelvin;
4,503±243° Kelvin;
5,028±283° Kelvin;
5,665±355° Kelvin; and
6,530±510° Kelvin.

14. The lighting device of claim 1, wherein the device is configured as a light fixture for a general lighting application to supply illumination in an area intended to be inhabited by a person.

15. The lighting device of claim 14, wherein the light fixture further comprises an optical integrating cavity having a reflective interior surface.

16. The lighting device of claim 1, wherein the device is configured as a lamp.

17. A light emitting device, comprising:

a solid state source for producing electromagnetic energy of a first emission spectrum; and at least three phosphors positioned to receive electromagnetic energy from the solid state source, each of the phosphors being of a type excited in response to electromagnetic energy of the first emission spectrum from the solid state source for re-emitting visible light of a different one of a plurality of second emission spectra, wherein:

(a) a visible light output of the light emitting device contains a combination of light of all of the second emission spectra from the phosphors, when the phosphors together are excited by electromagnetic energy of the first emission spectrum from the solid state source;

(b) the visible light output of the light emitting device produced when the phosphors are excited is at least substantially white and exhibits a color temperature corresponding to a rated color temperature for the light emitting device; and (c) the visible light output of the light emitting device produced when the phosphors are excited exhibits a radiation spectrum approximating a black body radiation spectrum for the rated color temperature for the device, over at least a predetermined portion of the visible light portion of the black body radiation spectrum for the rated color temperature.

18. The light emitting device of claim 17, wherein the visible light output of the light emitting device produced when the phosphors are excited:

(i) deviates no more than ±50% from a black body radiation spectrum for the rated color temperature for the device, over at least 210 nm of the visible light spectrum; and (ii) has an average absolute value of deviation of no more than 15% from the black body radiation spectrum for the rated color temperature for the device, over at least the 210 nm of the visible light spectrum.

19. The light emitting device of claim 17, wherein the visible light output of the lighting device produced when the phosphors are excited has a CRI of at least 85.

20. The light emitting device of claim 18, wherein the visible light output of the light emitting device produced when the phosphors are excited:

(i) deviates no more than ±42% from the black body radiation spectrum for the rated color temperature for the device, over at least 210 nm of the visible light spectrum; and (ii) has an average absolute value of deviation of no more than 12% from the black body radiation spectrum for the rated color temperature for the device, over at least the 210 nm of the visible light spectrum.

21. The light emitting device of claim 18, wherein the visible light output of the light emitting device produced when the phosphors are excited:

(i) deviates no more than ±37% from a black body radiation spectrum for the rated color temperature for the device, over at least 210 nm of the visible light spectrum; and (ii) has an average absolute value of deviation of no more than 11% from the black body radiation spectrum for the rated color temperature for the device, over at least the 210 nm of the visible light spectrum.

22. The light emitting device of claim 21, wherein the visible light output of the lighting device produced when the phosphors are excited has a CRI of at least 90.

23. The light emitting device of claim 18, wherein the visible light output of the light emitting device produced when the remote phosphors are excited:

deviates no more than ±37% from a black body radiation spectrum for the rated color temperature for the device, over at least 210 nm of the visible spectrum; and (ii) has an average absolute value of deviation of no more than 8% from the black body radiation spectrum for the rated color temperature for the device, over at least the 210 nm of the visible spectrum.

24. The light emitting device of claim 17, wherein the rated color temperature is one of the following color temperatures:

2,700° Kelvin;
3,000° Kelvin;
3,500° Kelvin;
4,000° Kelvin;
4,500° Kelvin;
5,000° Kelvin;
5,700° Kelvin; and
6,500° Kelvin.

25. The light emitting device of claim 24, wherein the visible light output from the device produced by the excitation of the phosphors has a color temperature in one of the following ranges:
2,725±145° Kelvin;
3,045±175° Kelvin;
3,465±245° Kelvin;
3,985±275° Kelvin;
4,503±243° Kelvin;
5,028±283° Kelvin;
5,665±355° Kelvin; and
6,530±510° Kelvin.

26. The lighting device of claim 17, wherein the device is configured as a light fixture for a general lighting application to supply illumination in an area intended to be inhabited by a person.

27. The lighting device of claim 26, wherein the light fixture further comprises an optical integrating cavity having a reflective interior surface.

28. The lighting device of claim 17, wherein the device is configured as a lamp.

29. A lamp for a general lighting application to supply illumination in an area intended to be inhabited by a person, the lamp comprising:
a bulb;
a housing for supporting the bulb;
a lamp base for receiving electricity from a lamp socket;
a plurality of solid state sources for producing electromagnetic energy of a first emission spectrum in response to power obtained from the electricity; and
at least three phosphors positioned to receive electromagnetic energy from the solid state sources, each of the phosphors being of a type excited in response to electromagnetic energy of the first emission spectrum from the solid state sources for re-emitting visible light of a different one of a plurality of second emission spectra, wherein:
(a) a visible light output of the lamp contains a combination of light of all of the second emission spectra from the phosphors, when the phosphors together are excited by electromagnetic energy of the first emission spectrum from the solid state sources;
(b) the visible light output of the lamp produced when the phosphors are excited is at least substantially white and exhibits a color temperature corresponding to a rated color temperature for the lamp; and
(c) the visible light output of the lamp produced when the phosphors are excited exhibits a radiation spectrum approximating a black body radiation spectrum for the rated color temperature for the device, over at least a predetermined portion of the visible light portion of the black body radiation spectrum for the rated color temperature.

30. The lamp of claim 29, wherein the visible light output of the lamp produced when the phosphors are excited has a CRI of at least 85.

31. The lamp of claim 29, wherein the visible light output of the lamp produced when the phosphors are excited:
(i) deviates no more than ±42% from the black body radiation spectrum for the rated color temperature for the lamp, over at least 210 nm of the visible light spectrum; and
(ii) has an average absolute value of deviation of no more than 12% from the black body radiation spectrum for the rated color temperature for the lamp, over at least the 210 nm of the visible light spectrum.

32. The lamp of claim 29, wherein the visible light output of the lamp produced when the phosphors are excited:
deviates no more than ±37% from a black body radiation spectrum for the rated color temperature for the lamp, over at least 210 nm of the visible light spectrum; and
(ii) has an average absolute value of deviation of no more than 11% from the black body radiation spectrum for the rated color temperature for the lamp, over at least the 210 nm of the visible light spectrum.

33. The light emitting device of claim 32, wherein the visible light output of the lighting device produced when the phosphors are excited has a CRI of at least 90.

34. The lamp of claim 29, wherein the visible light output of the lamp produced when the phosphors are excited:
(i) deviates no more than ±37% from a black body radiation spectrum for the rated color temperature for the lamp, over at least 210 nm of the visible spectrum; and
(ii) has an average absolute value of deviation of no more than 8% from the black body radiation spectrum for the rated color temperature for the lamp, over at least the 210 nm of the visible spectrum.

35. The lamp of claim 29, wherein the rated color temperature is one of the following color temperatures:
2,700° Kelvin;
3,000° Kelvin;
3,500° Kelvin;
4,000° Kelvin;
4,500° Kelvin;
5,000° Kelvin;
5,700° Kelvin; and
6,500° Kelvin.

* * * * *